US007600560B2

(12) United States Patent
Heuss et al.

(10) Patent No.: US 7,600,560 B2
(45) Date of Patent: Oct. 13, 2009

(54) DEVICE FOR REPLACING HEAT AND METHOD FOR THE PRODUCTION THEREOF

(75) Inventors: Hans-Peter Heuss, Korntal-Münchingen (DE); Michael Kohl, Bietigheim (DE); Bruno Lösch, Böblingen (DE); Matthias Traub, Korntal-Münchingen (DE); Christoph Walter, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 147 days.

(21) Appl. No.: 10/591,328

(22) PCT Filed: Mar. 3, 2005

(86) PCT No.: PCT/EP2005/002239

§ 371 (c)(1),
(2), (4) Date: Aug. 31, 2006

(87) PCT Pub. No.: WO2005/085738

PCT Pub. Date: Sep. 15, 2005

(65) Prior Publication Data

US 2007/0186575 A1 Aug. 16, 2007

(30) Foreign Application Priority Data

Mar. 5, 2004 (DE) ..... 10 2004 011 351

(51) Int. Cl.
*F28F 9/02* (2006.01)

(52) U.S. Cl. ..... 165/173; 165/174; 165/176; 165/153

(58) Field of Classification Search ..... 165/152, 165/153, 173, 174, 176, DIG. 481, DIG. 482
See application file for complete search history.

(56) References Cited

U.S. PATENT DOCUMENTS

| | | | | |
|---|---|---|---|---|
| 5,236,044 | A * | 8/1993 | Nagasaka et al. | 165/176 |
| 5,479,985 | A * | 1/1996 | Yamamoto et al. | 165/126 |
| 5,582,239 | A * | 12/1996 | Tsunoda et al. | 165/176 |
| 5,605,191 | A | 2/1997 | Eto et al. | |
| 6,082,448 | A * | 7/2000 | Haussmann | 165/174 |
| 6,142,217 | A * | 11/2000 | Haussmann | 165/176 |

(Continued)

FOREIGN PATENT DOCUMENTS

DE 195 15 526 C1 5/1996

(Continued)

*Primary Examiner*—Teresa J Walberg
(74) *Attorney, Agent, or Firm*—Foley & Lardner LLP

(57) ABSTRACT

A device which is used to replace heat, for a motor vehicle, includes at least one first collecting and/or distribution device for at least one fluidic medium. The collecting and/or distribution device is fluidically connected to a plurality of through-flow devices, through which the medium flows at least in parts. The collecting and/or distribution device includes at least one base device, a covering device and a separating device, which divides the collecting and/or distribution device into at least two partial areas. The base device includes at least one projection which protrudes in an inward manner from a predetermined plane of the base device in relation to the collecting and/or distribution device and at least one section of the separating device is in contact with at least one lateral side of the projection, and at least one section of the plane of the base device is in indirect contact.

49 Claims, 18 Drawing Sheets

U.S. PATENT DOCUMENTS

| | | | | |
|---|---|---|---|---|
| 6,202,741 | B1 * | 3/2001 | Demuth et al. | 165/176 |
| 6,293,334 | B1 | 9/2001 | Ghiani | |

FOREIGN PATENT DOCUMENTS

| | | | |
|---|---|---|---|
| DE | 196 03 016 | A1 | 7/1996 |
| DE | 102 26 753 | A1 | 1/2004 |
| EP | 0 270 433 | A1 | 6/1988 |
| EP | 0 656 517 | A1 | 6/1995 |
| EP | 0 864 838 | A2 | 9/1998 |
| EP | 0 709 644 | B1 | 12/1999 |

* cited by examiner

DEVICE FOR REPLACING HEAT AND METHOD FOR THE PRODUCTION THEREOF

BACKGROUND

The present invention relates to a heat exchanging apparatus and to a method for its production. Heat exchanging apparatuses are long known from the prior art, in particular in the field of motor vehicles. Said apparatuses have, in a known way, supply lines for a refrigerant, a distributing tube for distributing the refrigerant to a plurality of flat tubes, a collecting tube for collecting the refrigerant after it passes through the flat tubes, and an outlet. Here, it is possible to fill out the collecting and distributing tube in the form of a water box which has a separating wall. In doing so, however, it must be ensured that the separating wall sealingly divides the water box into an input-side partial region and an output-side partial region.

For this reason, in the prior art, separating walls are used which divide the water box into two partial spaces. This gives rise to the problem of joining the separating walls into the collecting box in the most cost-saving and yet sealing manner possible.

An aluminum water/air heat exchanger for motor vehicles is known from EP 0 656 517, in which a separating wall of a water box engages in grooves and/or slots in the tube plate, the engagement taking place with intersection of collars through which flat tubes are inserted. Here, the grooves have a rectangular shape and are delimited at all sides. The engagement of the separating wall or of its tongues ensures a relatively secure hold and relatively reliable sealing of the heat exchanger arrangement. During production, however, flux or solder can collect in the surrounded grooves, resulting in joining problems possibly arising during the production process.

The invention is therefore based on the object of reducing the outlay in the production of a heat exchanging apparatus.

It is also intended to provide a collecting box in which the input-side and output-side regions are reliably separated and sealed off from one another.

SUMMARY

The objects are achieved according to the invention by means of a heat exchanging apparatus which has at least one first collecting and/or distributing device for at least one liquid medium, the collecting and/or distributing device being fluidically connected to a plurality of throughflow devices through which the medium flows at least in sections, and the collecting and/or distributing device having at least one base device, one cover device and one separating device which divides the collecting and/or distributing device into at least two partial spaces. Here, according to the invention, the base device has at least one projection which protrudes inward with respect to the collecting and/or distributing device in a predefined plane of the base device, and at least one section of the separating device is in at least indirect contact with at least one side face of the projection and with a section of the plane of the base device.

The advantage of the invention is that, in this way, the separating wall is simultaneously in contact with two side faces, and as a result, the stability of the apparatus can be increased, which is of particular significance when relatively thin-walled components are used for the purpose of reducing weight and costs. According to the invention, it is additionally prevented that solder, liquid and the like collect in spatially delimited grooves during the production process.

A collecting and/or distributing device is to be understood as a device which can either distribute a fluid between a plurality of tubes or can collect a fluid which flows out of a plurality of tubes. Here, said distributing device has a base device and a cover device, that is to say the collecting and/or distributing device is constructed at least from a base device which is joined to a cover device. The predefined plane of the base device is a geometric plane from which the inwardly protruding projections protrude, and relative to which further edge regions can also be elevated or lowered. Here, the plane of the base device is to be understood as that plane against which the separating device rests. To be more precise, the plane of the base device is to be understood as that plane against which or against which the separating device rests. Said plane is therefore to be understood as a reference plane with respect to further planes, as is explained with reference to the figures.

Here, inwardly projecting is to be understood to mean that the projection protrudes into the interior of the collecting and/or distributing device. At least indirect contact is to be understood to mean that the individual faces in question can either touch each other directly or that a further material or a further medium is arranged between said faces. This can, for example, involve a layer of solder, or flux, or the like.

In a further preferred embodiment, the inwardly protruding projection has at least one side face which forms a substantially right angle with the plane of the base device, the separating device being arranged at said right angle. This is to be understood to mean that the projection, as described above, can have any desired geometric shape, but with one of its outer faces enclosing a right angle together with the plane of the base device. Here, the separating device is arranged at said right angle, and is in indirect contact at one side with the side face of the projection, and in indirect contact at the other side with that section of the base device which adjoins said side face.

In a further preferred embodiment, a plurality of inwardly protruding projections are provided. Here, all of said inwardly protruding projections preferably each have one side face which is aligned perpendicular to the plane of the base device.

In a further preferred embodiment, the plurality of inwardly protruding projections are arranged substantially in a line. This means that those side faces of the projections which are in contact with the separating device, and which preferably enclose a right angle with the plane of the base device or of the plate face, are arranged substantially in a plane. Said plane is preferably aligned substantially perpendicular to the plane of the base device.

The separating device is arranged at the side face of the individual projections, and is in at least indirect contact with the individual side faces and with the plane of the base device. Here, the individual projections can be at a predefined distance from one another. In a preferred embodiment, the individual projections are interrupted by means of openings in the base device, through which openings the individual throughflow devices can extend into the interior of the collecting and/or distributing device, the openings and the projections preferably being arranged in an alternating fashion.

In a further preferred embodiment, the plurality of projections and sections are arranged so as to be alternately laterally offset relative to one another. This substantially means that a first partial quantity of the plurality is arranged in a first line, and a second partial unit of the plurality is arranged in a second line, said lines preferably being parallel to one another. The side faces of those projections which are alternately laterally offset relative to one another and are in contact with the separating device are preferably in each case situated substantially obliquely opposite one another at a predefined angle. This means that the individual projections are arranged in a zigzag fashion relative to one another, and those side faces which are in contact with the separating device, or the planes which is defined by the individual side faces, are situated substantially opposite one another in parallel.

During assembly, the separating wall is arranged between the individual projections in such a way that the sections are in contact with the separating device in each case alternately from different sides. For example, the first, the third, the fifth, the seventh etc. projections are in contact with one side of the separating device, while the second, the fourth, the sixth and the eighth sections are in contact with the other side of the separating wall device.

In a further preferred embodiment, the separating wall has a thickness of from 0.2 mm-5 mm, preferably of between 0.4 mm and 2 mm and particularly preferably of from 0.8 mm-1.2 mm. The separating wall is preferably at least partially coated with a layer, such as in particular—but not exclusively—solder-plated, with zinc or the like. It has been proven that a thickness of the separating wall in the specified range particularly advantageously provides both a weight and cost saving, but also reliable separation of the collecting box.

In a further preferred embodiment, the inwardly protruding projections have a face—in particular a surface—which runs substantially parallel to the base device. In a further preferred embodiment, the inwardly protruding projections have a face which runs substantially obliquely with respect to the plane of the base device. The inwardly protruding projections therefore have the design of a step which has at least one oblique face.

In addition, the projections can have further faces which are substantially perpendicular to the plane of the base device, said faces preferably also being aligned perpendicular to the previously mentioned faces. Assuming the image of a step, said faces would be side faces which delimit the width of the step.

In a further preferred embodiment, the inwardly protruding projections have a height of between 2 mm and 10 mm, preferably of between 3 mm and 8 mm, and particularly preferably of between 4 mm and 6 mm.

The extent of the side faces in the longitudinal direction of the collecting and/or distributing device is between 2 mm and 10 mm, preferably between 3 mm and 8 mm, and particularly preferably between 4 mm and 6 mm.

It has been proven that the resulting side face, which is aligned substantially perpendicularly to the plane of the base device, particularly advantageously ensures secure contact with the separating device.

In a further preferred embodiment, the inwardly protruding sections extend in a substantially uninterrupted fashion in the longitudinal direction of the base device. This means that a step is generated which is substantially continuous in the longitudinal direction of the base device, the separating device being arranged at said step.

In a particularly preferred embodiment, the separating device is in at least indirect contact with at least one respective side face of all the inwardly protruding sections.

Here, a connecting medium is particularly preferably provided in the contact region between the base device and the side face, at one side, and the separating device, at the other side, in order to provide a cohesive connection between the separating device and the base device. Said connecting medium is selected from a group of connecting media which includes aluminum-containing solders, flux and the like.

In a further preferred embodiment, the separating device is embodied as a separating wall. This means that the separating device is a substantially two-dimensional structure which runs in the interior of the collecting and/or distributing device.

In a further preferred embodiment, the base device has a plurality of passage openings, the plurality of passage openings particularly preferably having a substantially slotted-hole-like profile. Here, the individual projecting sections are preferably in each case arranged between the passage openings.

The passage openings are used to insert a plurality of throughflow devices, which have a flat-tube-like profile, into the collecting and/or distributing device. For this purpose, the passage openings have profiles which are matched to those of the throughflow openings. The flat-tube-like throughflow devices particularly preferably have two flow paths for a liquid and/or gaseous medium which are separated from one another.

Said separation can be provided by means of a separating wall in the interior of the throughflow device, but it would also be possible for the throughflow devices to be pressed together in a preferably central region, in order to thus generate two chambers. It is additionally possible for the separation between the two regions to be generated during the course of a brazing process.

A slotted-hole-like profile is to be understood to mean that the openings extend substantially in one direction, and in contrast to only a small extent in a direction which is perpendicular to said direction. In a further preferred embodiment, the plane defined by the separating device substantially represents a plane of symmetry of the base device. Here, the individual passage openings are also divided substantially down the middle by the separating device. Any outlets or the like which are provided are not included in said symmetrical view.

In a preferred embodiment, the passage openings have peripheral edges or flanges. The throughflow devices are inserted through said flanges during production, and are preferably connected to the flanges in a positively-locking and/or cohesive and/or non-positively locking fashion.

The flanges preferably point inward with respect to the collecting and distributing device, that is to say in the direction of the ends of the throughflow devices. The flanges are preferably matched to the shape or design of the throughflow devices and substantially completely surround the latter. Here, substantially completely is to be understood to mean that relatively small regions, for example the region in which the separating region of the throughflow device is provided, can however be cut out from the flanges in the peripheral direction.

The connection between the base device and the throughflow tubes can be facilitated by means of the inwardly protruding flanges.

In a further preferred embodiment, the ends of the flanges are arranged at a level which differs from the plane of the base device. In concrete terms, the ends of the flanges point further into the interior of the collecting and/or distributing device compared to the level of the base device, or, in a particularly preferred embodiment, less far. In the latter case, that is to say in the case in which the plane of the base device is arranged higher than the level of the flanges, this leads to the separating wall or separating device which is inserted into the base device being situated above the flanges, and the flanges therefore do not intersect the separating device. An increased sealing effect can be obtained in this way.

In a further embodiment, the flanges point outward with respect to the collecting and/or distributing device. In a further embodiment, some of the flanges point inward with respect to the collecting and/or distributing device, while others point outward.

It would in principle be possible to provide passage openings which are each separate from one another on both sides of the separating wall in the installed state. In a preferred embodiment, however, the passage openings extend over most of the width of the base device and are also preferably connected to one another in their central region by means of a narrowed region.

In a further preferred embodiment, the length of the base device exceeds the length of the separating device. Here, the separating device is preferably in contact with both the base device and the cover device and connects said devices. Here, the plurality of throughflow devices of substantially flat-tube-like cross section are preferably inserted into the plurality of individual passage openings, and, in a subsequent working step, soldered.

In a further preferred embodiment, that side face of the inwardly protruding projections which is in contact with the separating device is larger than that section of the base device which is in contact with the separating device. This means that the respective side face exceeds the size of the face which is associated with it in the plane of the base device, which is preferably aligned perpendicular to said side face. In this way, the separating wall can be particularly advantageously supported within the collecting and/or distributing device.

In a further preferred embodiment, that section of the base device which is in contact with the separating device is wider than the thickness of the separating device. The separating device is therefore preferably not inserted into a groove or a slot, but rather the plate region in which there is contact with the separating device is wider than the separating device itself.

In a further preferred embodiment, a plurality of support devices are provided which project relative to a predefined plane or base face of the base device. Said support devices are projections of a predefined length which have the effect that the base device is stabilized against bending. Here, the individual support devices are arranged substantially between the passage openings. At least some of said support devices preferably merge into the projections. This means that in each case one support device has an approximately T-shaped profile with the projection.

In a further preferred embodiment, the base device has a projecting peripheral edge. This means that an edge is provided which extends upward, for example in the direction of a second cover device, proceeding from the plane of the base device. The peripheral edge serves to connect the base device to a cover device. The base device particularly preferably has at least one lug, preferably a plurality of lugs, at its peripheral edge. Said lugs likewise serve to provide a connection to a second cover device, in order to thus join a base device and a cover device together to form a collecting and/or distributing device.

In a further preferred embodiment, the separating device, in particular the separating wall, is aligned substantially parallel to the passage openings. The separating device is preferably arranged in a holding section which has guide faces for holding the separating device.

The present invention is also aimed at a method for producing a heat exchanging apparatus having the following method steps. In a first method step, a base device having at least one projection is produced; in a further method step, at least one connecting medium is applied to at least one side face of the projection.

In addition, the connecting medium is also applied to at least one section, which adjoins the side face of the at least one projection, of the base device. In a further step, the separating device is arranged on the base device such that the separating device is in at least indirect contact both with the base device and with the side face of the projection.

Here, a plurality of projections are preferably provided, the separating device being placed in contact with said projections or with the side faces of said projections.

In the method, the separating device is preferably placed, and subsequently soldered, onto the side faces of the individual projections, the action of gravity being utilized to produce the contact between the side faces and the separating device during the soldering process.

In a further preferred embodiment, at least one inwardly protruding projection is generated by means of a machining operation on the base device, the machining operation being selected from a group of machining operations which includes punching, deep-drawing and the like.

In a further preferred embodiment, that section of the base device which adjoins the inwardly protruding section runs substantially in the plane of the base device. This means that the base device is, for example, in the form of a metal sheet, with the individual passage openings being punched out, for example, and the individual elevations such as the support devices and the inwardly protruding sections being produced by means of pressing, drawing or the like.

The plane of the base device can therefore be understood as that plane from which the inwardly protruding sections and the other devices extend, and which is in contact with the separating wall.

A support device is also preferably generated in the base device, said support device particularly preferably merging into at least one inwardly protruding section. A plurality of passage openings are also preferably punched into the base device, with flanges of each passage opening particularly preferably being generated, said flanges protruding into the interior of the collecting and/or distributing device. Here, said flanges preferably substantially completely surround the individual passage opening. Here, substantially completely is to be understood to mean that a small region, through which the separating device runs, of the flanges can however be cut out.

It is additionally preferable for one flat-tube-like throughflow device to be at least partially inserted into each passage opening, and a positively locking and/or cohesive and/or non-positively locking connection to be generated between the base device and each throughflow device.

The connection between the base device and the plurality of throughflow devices is particularly preferably generated by means of a method selected from a group of methods which includes soldering, brazing, welding and the like, and combinations of said methods.

The separating device is also preferably pressed with a predefined force both against a side face of the projection and also against the section of the base device. Here, as described above, the action of gravity can preferably be utilized in applying pressure to the side face.

Edges which surround the base device are also preferably generated by means of a further method step. It is also possible to make use of a process such as for example a deep-drawing process or a bending process or the like for generating said edges.

The invention is also aimed at the use of the above described heat exchanging apparatus in air conditioning systems of motor vehicles.

BRIEF DESCRIPTION OF THE DRAWINGS

Further advantages of the device according to the invention and of the method can be gathered from the appended drawings, in which.

DETAILED DESCRIPTION

Figure 1:
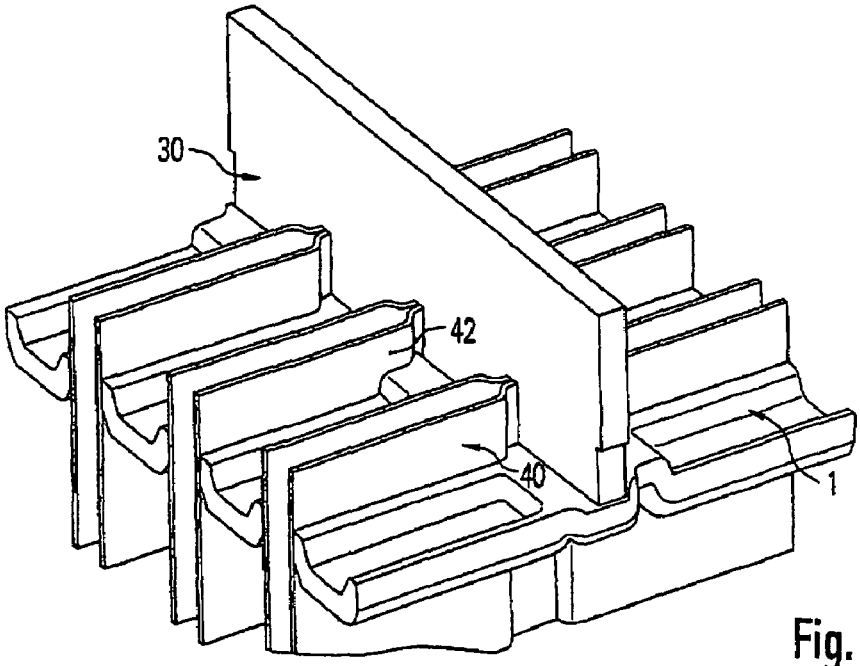
FIG. 1 is a detail illustration of a heat exchanging apparatus according to the invention.

FIG. 1 illustrates a detail of a heat exchanging apparatus according to the invention. Here, the apparatus according to the invention has a plurality of throughflow devices 40 which are arranged substantially parallel to one another. An end section 42 of at least one end of said throughflow devices 40 projects through a base device 1. In a preferred embodiment, a further base device of the type shown here is arranged at the lower end of the throughflow devices 40. In the assembled state, the heat exchanging apparatus has a cover device (not illustrated) which has the effect of generating two partial spaces which are separated from one another by means of the separating wall 30, one partial space being situated to the left of the separating wall in the figure, and one partial space being situated to the right of the separating wall 30 in the figure. The spaces are separated by the separating wall 30 in a substantially gas-tight and/or liquid-tight manner.

Figure 2:
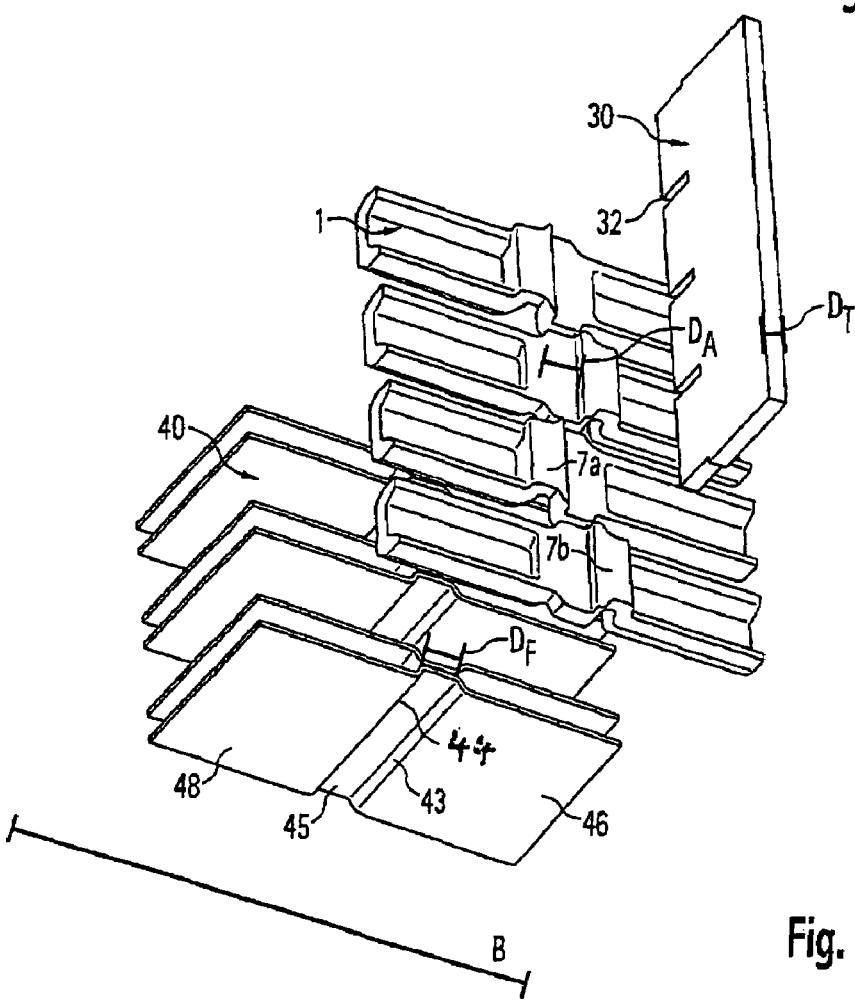
FIG. 2 is an exploded illustration of the detail illustration from FIG. 1.

FIG. 2 is an exploded illustration of a detailed view from FIG. 1. The separating wall 30 has a thickness $D_T$ of between 0.2 mm and 5 mm, preferably of between 0.5 mm and 3 mm and particularly preferably of between 0.7 mm and 1.2 mm. The separating wall has a plurality of recesses or slots 32, into which the regions 45 of the individual flat tubes 40, or the ends of said regions, are inserted during assembly. This is illustrated in FIG. 1 in the assembled state.

In said embodiment, the individual throughflow devices 40 have a first flow chamber 46 and a second flow chamber 48. The cross section of said flow chambers 46 and 48 is of substantially flat-tube-like form, and therefore has, in cross section, a predefined length and a width which is considerably reduced relative to said length. It is also possible to provide, instead of the flow chambers, a plurality of ducts for the liquid or refrigerant. Between the flow chambers 46 and 48, the throughflow devices have a narrowed region 45. The thickness $D_F$ of said narrowed region is preferably between 0.5 mm and 6 mm, preferably between 1 mm and 4 mm, and particularly preferably between 1.5 mm and 2.7 mm.

As described above, the flow chambers 46 and 48 are separated from one another in a gas-tight and/or liquid-tight manner in said narrowed region 45. During production, the narrowed regions can be generated by pressing the throughflow devices at the corresponding point. In addition, said regions can also receive solder plating on the inner walls, so that a gas-tight and/or liquid-tight connection is generated during a soldering operation.

The reference symbols 43 and 44 denote transition regions between the flow chambers 48 and 46. In said regions, the width of the throughflow devices preferably decreases towards the region 45 at a predefined angle relative to the transverse direction 1B. Said angle is preferably between 10° and 90°, preferably between 30° and 90° and particularly preferably between 60° and 85°. However, it is also possible for the regions 43 and 44 to curve or narrow in the form of an arc toward the central region 45. In FIG. 2, the reference symbols 7*a* and 7*b* respectively denote a left-hand and a right-hand projection which is provided in the base device. Here, the projections are in each case arranged alternately on the left-hand side and on the right-hand side with respect to the separating wall 30. The spacing $D_A$ between the projections 7*a* and 7*b*, that is to say in this case between a projection 7*b* and the position which corresponds to the position at which an adjacent projection 7*a* is arranged, is preferably between 0.5 mm and 8 mm, preferably between 1.5 mm and 5 mm, and particularly preferably between 1.8 mm and 4 mm.

Figure 3:
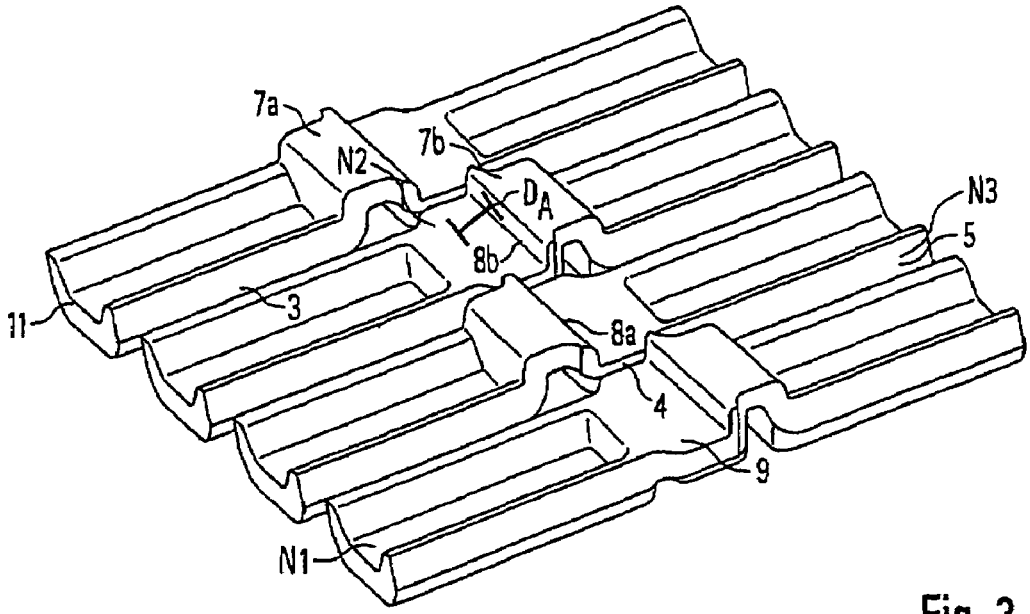
FIG. 3 is a detail illustration of a base device according to the invention in a first perspective view.

FIG. 3 shows a detailed view of a first embodiment of a base device according to the invention. Here, the reference symbols 7*a* and 7*b* each respectively relate again to left-hand and right-hand projections. The reference symbol 8*b* denotes a section, which is in contact with the separating wall 30, of the projection 7*b*. In the same way, sections 8*a* of the projections 7*a* are also in contact with the separating wall 30. In said embodiment, the individual projections 7*a* or the sections 8*a* are arranged substantially in a plane which is aligned perpendicular to the plane of the base device. The sections 8*b* of the projections 7*b* are likewise arranged in a plane which is perpendicular to the plane of the base device, but are laterally offset relative to the former plane. The spacing $D_A$ therefore also denotes the spacing between said two planes.

Reference symbol 9 denotes a section of the base device with which the separating device is in at least indirect contact. Here, said section of the base device is situated substantially in the plane of the base device.

As illustrated, an arrangement with alternating steps 7*a* and 7*b* is provided in said embodiment.

It can be seen from FIG. 3 that that section of the base device which is in at least indirect contact with the separating device 30 is at a predefined height level N2, and the level N1 of the regions 11 of the base device is lower than said height level N2. N2 therefore denotes the level of the plane of the base device and therefore the level of the reference plane mentioned in the introduction. The reference symbol 3 relates to a gap or a passage opening through which the end region 42 of the throughflow device 40 can be inserted. Said gap has a narrowed central region 4 which, as described above, is provided for holding the narrowed end region 45 of the throughflow device 40.

The reference symbol 5 relates to a collar which ensures that the throughflow device 40 which is inserted through the passage openings is held securely.

It can be seen that the level N2 on which the plate section 9 of the base device is arranged is situated above the level N3 in which the collars 5 end.

It would also be possible, however, to provide other relationships between the levels N1, N2 and N3 here. All the levels, for example, could be situated at the same height, and the level N2 could be arranged below the level N3.

Figure 4:
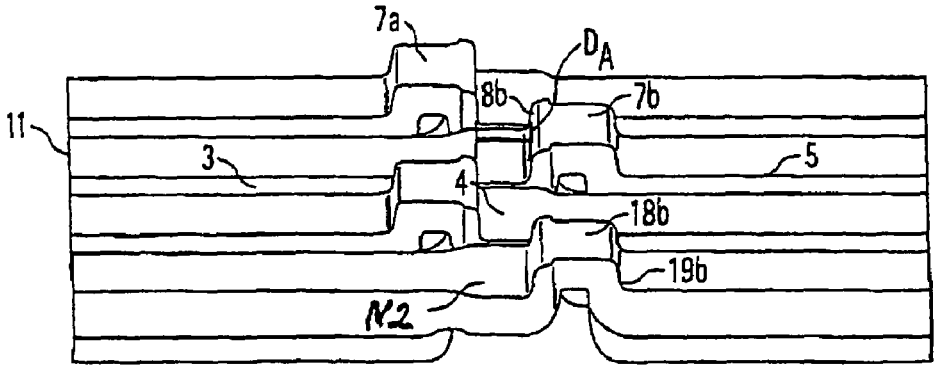
FIG. 4 shows a further perspective view of the base device from FIG. 3.

FIG. 4 shows a further view of the base device from FIG. 3. Here, it can be seen that the alternately arranged projections 7*a* and 7*b* are each in the form of steps. This means that an upper section 18*a*, 18*b* is provided adjacent to the sections 8*a* and 8*b* against which the separating wall 30 bears, said upper section 18*a*, 18*b* running substantially perpendicularly to the section 8*a*, 8*b*. A rear section 19*a*, 19*b* is also provided adjacent thereto, said rear section 19*a*, 19*b* running substantially parallel to the section 8*b* and substantially perpendicular to the section 18*b*. In this way, the projections 7*a*, 7*b* substantially have the design of an inverted U. The height of the projections, that is to say the spacing between the upper face 18*b* and the section 9, is between 0.3 mm and 3 mm, preferably between 0.6 mm and 2 mm, and particularly preferably between 0.8 mm and 1.5 mm.

The reference symbol 11 relates to support devices, whose surface is situated at the level N1, in the base device.

Figure 5:
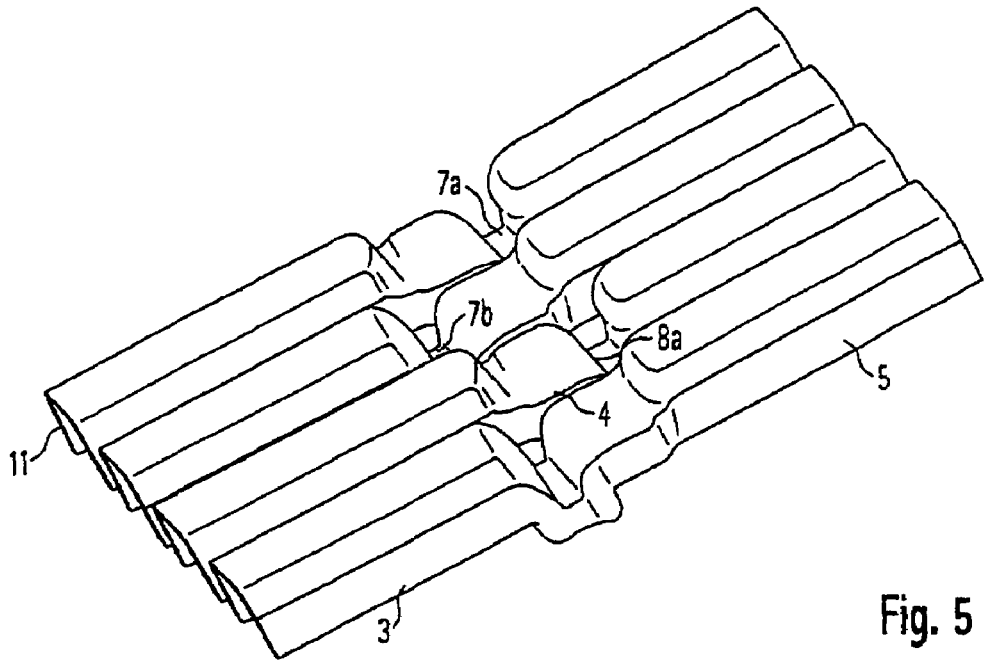
FIG. 5 shows a rear view of the base device from FIG. 3.

FIG. 5 shows a rear view of the base device according to the invention. Here, the reference symbol 3 in turn denotes an opening provided for inserting the throughflow device, and the reference symbol 4 denotes the narrowed region in the center. The reference symbol 8*a* relates here to the rear part of that section in which the separating wall 30 is arranged. It can also be seen in said illustration that the level of the plate section 9 is offset relative to the level of the recesses 11.

Figure 6:
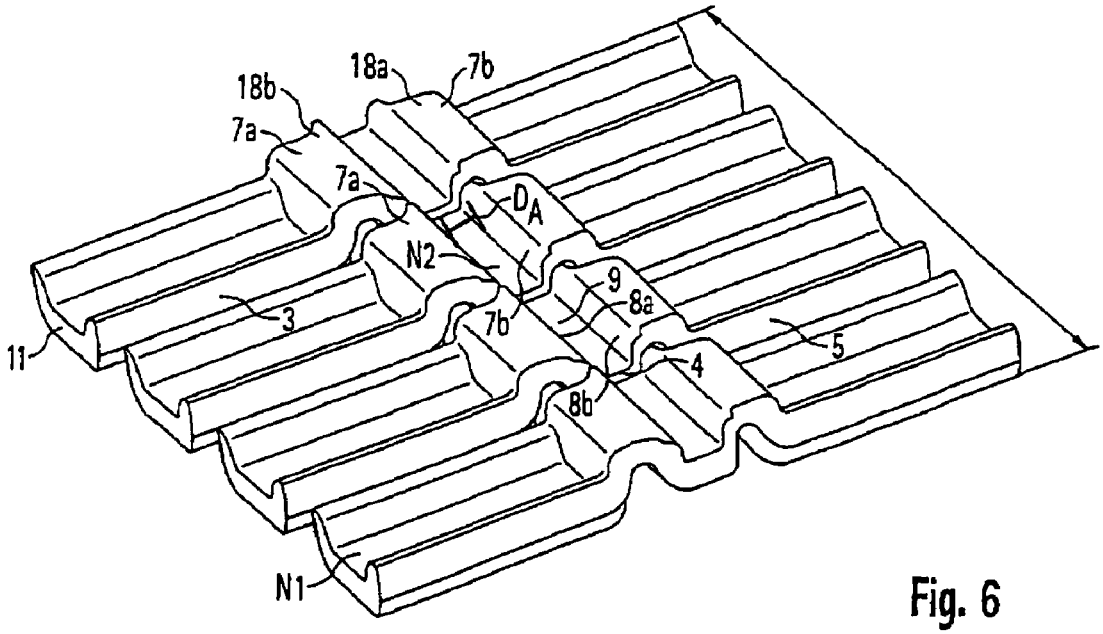
FIG. 6 shows a detailed view of a further embodiment of a base device according to the invention.

FIG. 6 shows a detailed view of a further embodiment of the base device according to the invention. In contrast to the embodiment shown above, projections 7*a* and 7*b* are arranged here at both sides of the plate section 9. The separating wall (not shown) is provided between said projections, and the throughflow devices (likewise not shown) are inserted through between said projections from below.

In said embodiment, the separating wall bears both against the sections 8*b* of the projections 7*b*, and against the sections 8*a* of the projections 7*a*. It is however also possible to select the thickness of the separating wall to be less than the thickness $D_A$ in FIG. 6. In this case, the separating wall preferably bears either against the sections 8*a* or against the sections 8*b*. In addition, the separating device can also have a corrugated or serrated profile and bear alternately against the projections 8*a* and 8*b*.

As in FIG. 3, the faces 18*a* and 19*a*, and 18*b* and 19*b*, are shorter in the longitudinal direction I of the base device than the corresponding faces 8*b* and 8*a*. The reason for this is that the sections 8*b* are designed such that they are matched to the narrowed central region 45 of the respective flat tubes, and therefore the spacing of the individual faces 8*a* and of the faces 8*b* is matched to the thickness of the throughflow devices in the central region 45. The plate section 9 is also situated at a higher level than the respective sections 11 in said embodiment.

Figure 7:
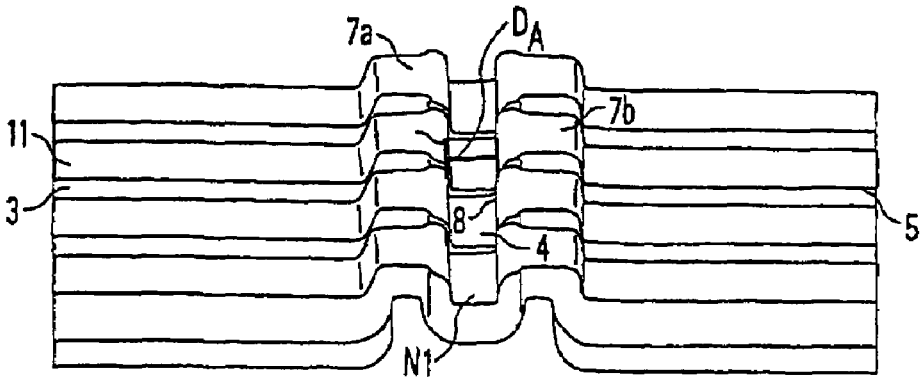
FIG. 7 is a further illustration of the base device from FIG. 6.

FIG. 7 shows a further view of the embodiment of the base device shown in FIG. 6. As can be seen from FIG. 7, the base device is preferably symmetrical about a geometric plane which preferably runs centrally with respect to the separating wall (not illustrated).

Figure 8:
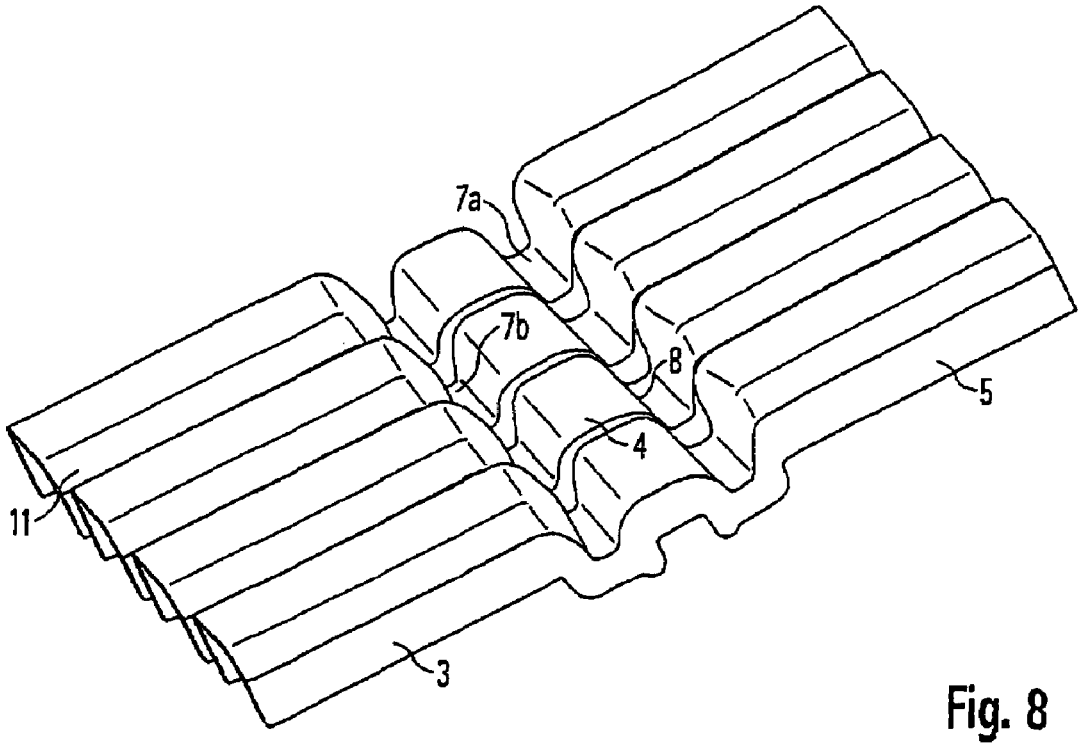
FIG. 8 shows a rear view of the base device from FIG. 6.

FIG. 8 shows a lower view of the embodiment shown in FIG. 7. The bulges of the support devices 11 serve to increase the stability of the base device. The collars 5 also serve in said embodiment to securely hold the throughflow tubes which are inserted through the respective openings 3. In a preferred embodiment, the respective throughflow tubes (not illustrated) or their end sections can be at least partially folded around the collars 5 in order to thus provide a mutual hold.

In all of the hitherto mentioned embodiments, a flux or solder medium which is applied to the plate sections 9 and the respective side sections 8*a* and 8*b* of the projections 7*a*, 7*b* during the production process in each case can flow off and does not collect within a closed-off region. While the medium can in each case flow off both in the direction of the openings 3 or the gap 4 and in the directions which oppose the respective projections in the embodiment shown in FIGS. 3 to 5, the medium can flow off substantially only in the direction of the respective openings 3 and 4 in the embodiment shown in FIGS. 6 to 8.

Figure 9:
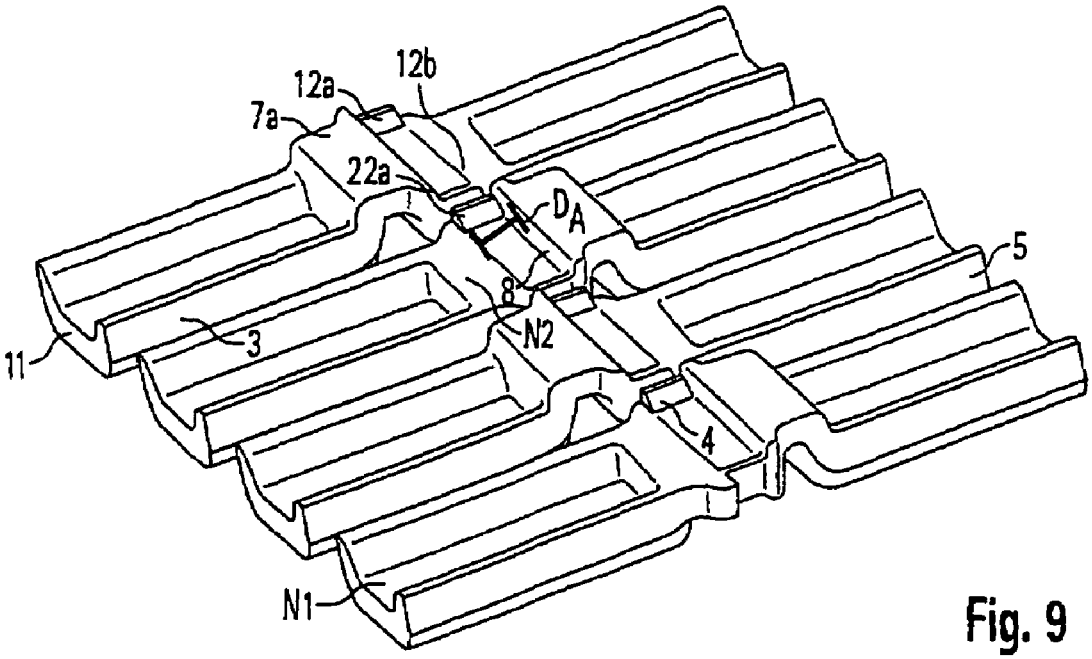
FIG. 9 shows a detailed view of a further embodiment of a base device according to the invention.

The embodiment of the base device according to the invention shown in FIG. 9 approximates to the embodiment shown in FIG. 3. Auxiliary projections 12*a* and 12*b*, which facilitate the insertion of the separating wall, are additionally provided in this embodiment. For this purpose, the separating wall preferably has, in addition to the openings or slots 32, tongues or end regions (not illustrated) whose design takes into consideration the projections 12*a* and 12*b*. Instead of said embodiment, it would also be possible however to provide only each of the longitudinal side auxiliary projections 12*a* or only each of the right-hand side auxiliary projections 12*b*. It would also be possible to arrange auxiliary projections 12*a* and 12*b* in each case alternately on the individual plate sections 9.

The auxiliary projections 12*a* and 12*b* have faces 22*a* which is inclined at a predefined angle relative to the plate face 9. Said angle is preferably between 0 and 90°, preferably between 10 and 70° and particularly preferably between 20 and 50°. In said embodiment, the individual auxiliary projections substantially end with the respective collars 5. However, with regard to their height level, the projections can also extend higher than the collars 5, or not extend as high as the level of the collars 5.

The advantage of the auxiliary projections 12*a* and 12*b* is that of obtaining additional stability when inserting the separating walls. In a further preferred embodiment, it would also be possible to guide in each case one auxiliary projection 12*a* and one auxiliary projection 12*b* together such that they touch. In this case, however, the separating wall would preferably need to have a corresponding notch (not illustrated).

It is also the case in said embodiment that the ends of the collars 5 are preferably arranged below the plane of the base device, that is to say the plane of the section 9.

Figure 10:
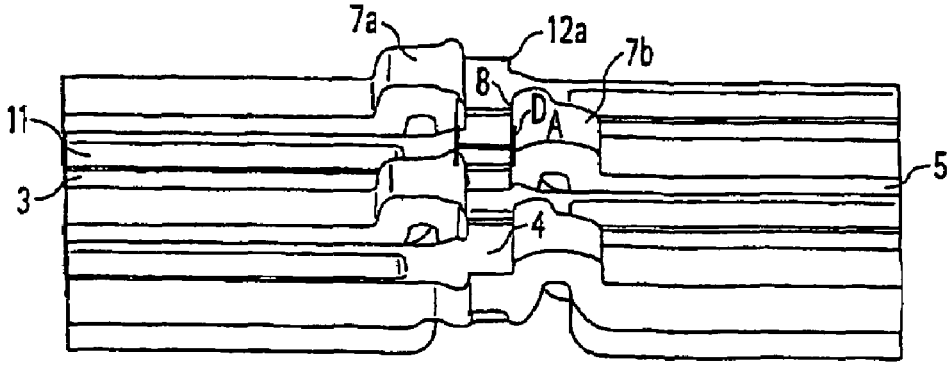
FIG. 10 is a further illustration of the base device from FIG. 9.

FIG. 10 illustrates a further view of the embodiment of the base device from FIG. 9. It can be seen that, in terms of their height, the auxiliary projections 12*a* and 12*b* do not quite extend to the height level of the projections 7*b*. However, this is not necessary, and it would also be possible for the auxiliary projections to be situated higher than, or at the same level as, the main projections 7*b*. In the embodiment shown here, the highest level is that of the projections 7*b*, followed by the level of the auxiliary projections 12*a*, 12*b* and of the collars 5, and finally, the lowest level is that of the indentations 11.

The spacing $D_A$ in said embodiment also substantially corresponds to the spacings shown in the preceding embodiments. In said embodiment, the solder medium can preferably flow off to each side at which no projection 7*a* or 7*b* is arranged. The auxiliary projections 12*a* and 12*b* can additionally be arranged such that a gap, through which a liquid connecting medium can pass, is formed between the auxiliary projections and the associated section 7*a* and 7*b*.

Figure 11:
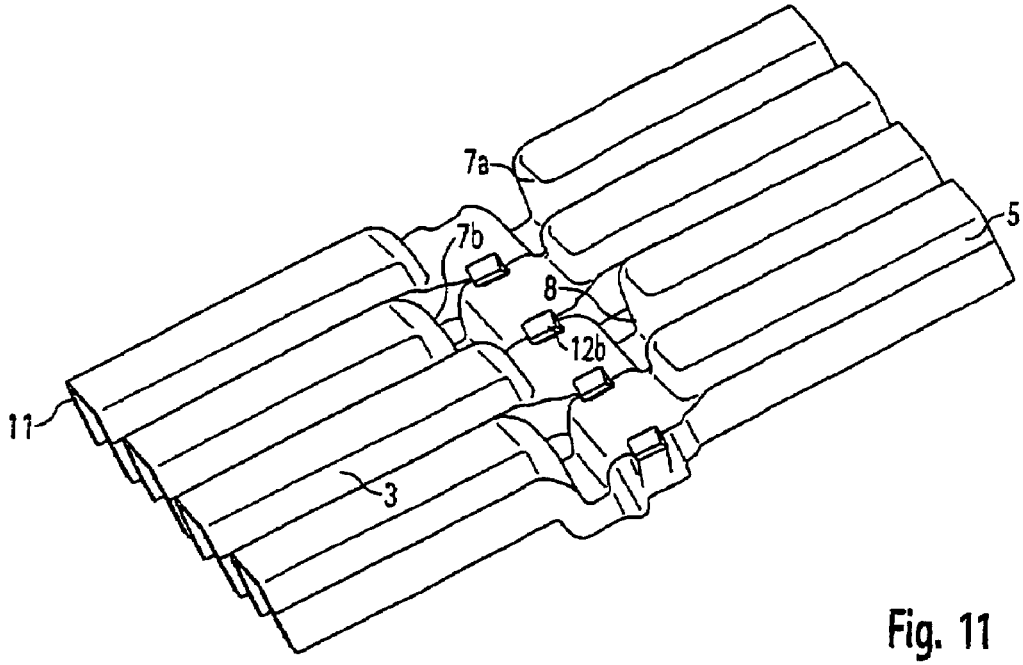
FIG. 11 shows a rear view of the base device from FIG. 9.

FIG. 11 shows a rear view of the embodiment shown in FIGS. 9 and 10. In particular, the auxiliary devices 12*b* can also be seen here, whereas the auxiliary devices 12*a* are situated at the side facing away in each case.

Figure 12:
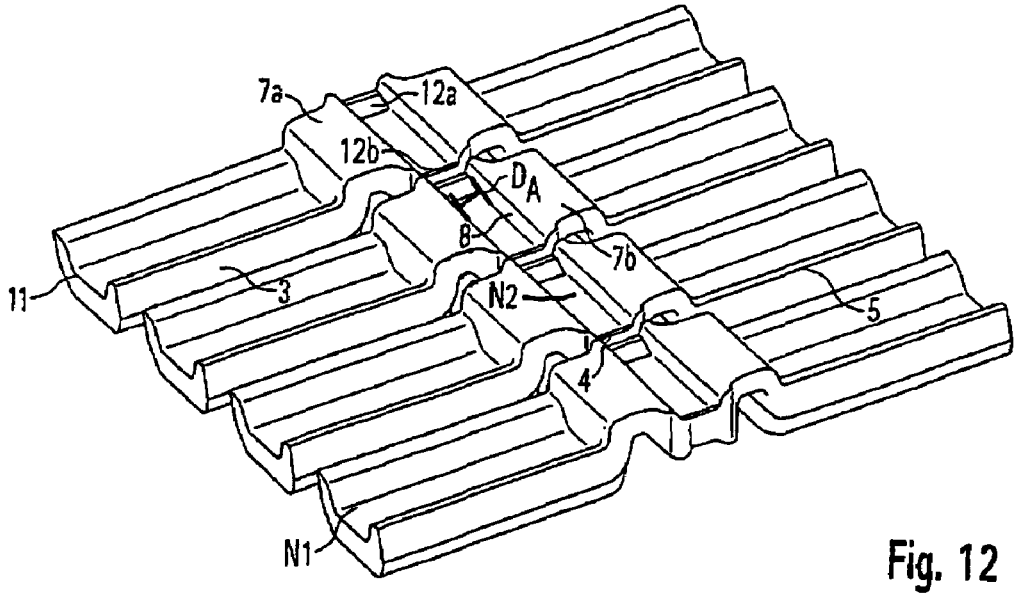
FIG. 12 shows a detailed view of a further embodiment of the base device according to the invention.

The further embodiment of the base device according to the invention shown in FIG. 12 approximates to the embodiment shown in FIG. 6. However, auxiliary projections 12*a* and 12*b* which facilitate the insertion of the separating wall are also provided in the embodiment shown in FIG. 12. On account of the level of the auxiliary projections 12*a* and 12*b* being lower than the projections 7*a* and 7*b*, it is also possible here for a medium, for example flux, to flow off in the direction of the openings 4 during production. In addition, gaps which permit a flux to pass through can also be provided here between the sections 8*a*, 8*b* at one side and the auxiliary projections at the other side.

Figure 13:
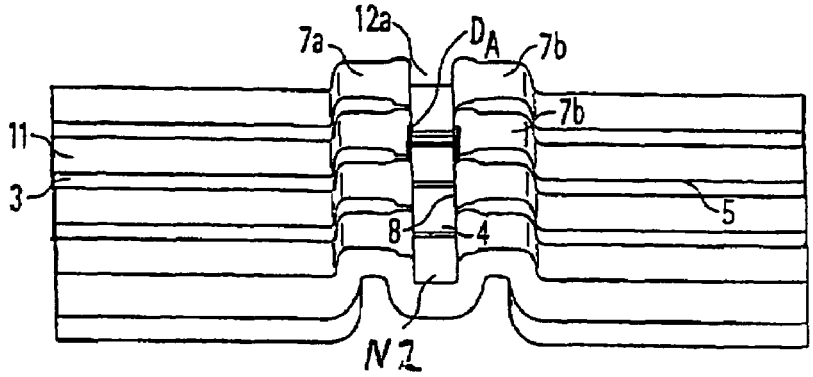
FIG. 13 is a further illustration of the plate view from FIG. 12.

FIG. 13 shows a further view of the embodiment shown in FIG. 12. The auxiliary projections 12*a* and 12*b* are also provided here. It is also the case in said embodiment that the plate section 9 and the collars 5 are situated at a different height level, more precisely, the section 9 is situated higher than the ends of the collars 5.

Figure 14:
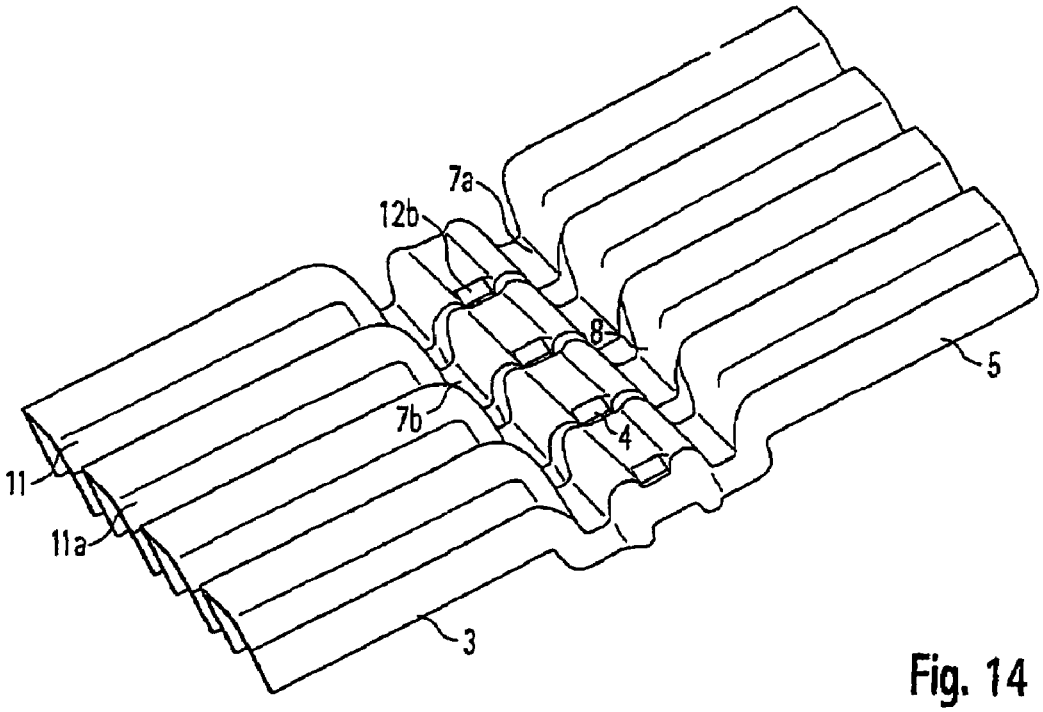
FIG. 14 shows a rear view of the base device from FIG. 12.

FIG. 14 illustrates a rear view of the embodiment shown in FIGS. 12 and 13. It can also be seen in this case that the respective projections on the rear side assume approximately the shape of a U. The auxiliary projections 12*a* and 12*b* are also illustrated in this case with the inclination relative to the plate section as shown above.

In the side view of said figure, the regions 11 likewise have the shape of an inverted U, one side face of the section 11 running substantially parallel to the plate section 9 and a further section 11*b* or 11*a* being arranged at a predefined angle. Said angle is between 0 and 90°, preferably between 20 and 70° and particularly preferably between 30 and 60°.

Figure 15A:
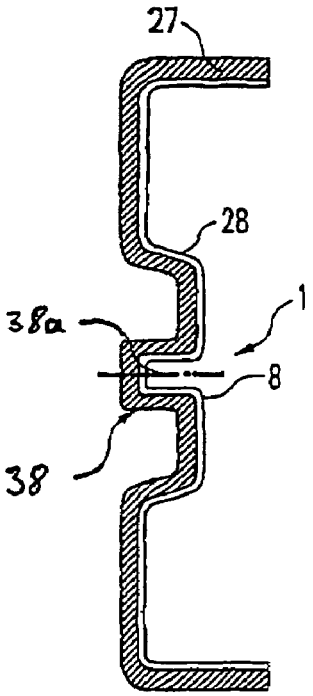
FIG. 15*a* is a schematic illustration of a base device according to the prior art.

FIG. 15*a* shows a cross-sectional illustration of a base device according to the prior art. A groove 38 is provided in said base device, the separating wall (not illustrated) being inserted into said groove. The reference symbol 28 relates to a flux or solder which is applied to the base device. Here, in the prior art, the groove 38 also ends in the plane of the page. This leads to the flux collecting on the base of the groove, and in some circumstances the subsequently inserted separating wall no longer being able to reach the base of the groove. In addition, the thickness of the flux on the side wall 38*a* of the groove 38 can vary widely, which can result in joining problems.

Figure 15B:
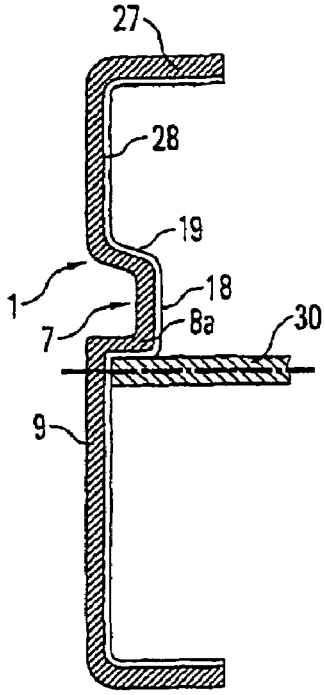
FIG. 15*b* is a schematic illustration of a base device according to the invention.

FIG. 15*b* schematically shows a cross section of a base device according to the invention. On account of the step 7 at one side, the flux can flow off here laterally, so that an approximately constant flux thickness is produced. It is possible in this way to better overcome the joining problems.

Figure 15C:
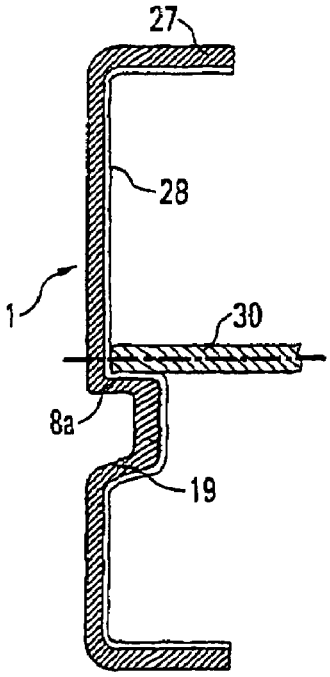
FIG. 15*c* shows a schematic plan view of a base device according to the invention.

In the embodiment shown in FIG. 15*b*, the step has a section 8*a* which is aligned substantially perpendicularly to the plate section 9. However, the angle may be selected so as to deviate from this, for example the separating wall may also have a chamfered region, which is matched to such a chamfer, in the lower region. The section 18 of the projection 7 is substantially parallel to the plate section 9. The section 19 is arranged at an angle relative to the section 18. Here, the angle is between 0 and 90°, preferably between 20 and 70°, and particularly preferably between 40 and 60°. The reference symbol 27 denotes lateral edges which are provided on the base device, said edges serving to provide the connection to a cover device (not shown). FIG. 15*c* shows a further embodiment of a base device according to the invention. Here, the projection substantially has the design of an open rectangle, that is to say the section 19 and the section 8*a* run substantially parallel to one another. In the preferred production method, it is possible to place the separating wall on the section 8*a*, with the separating wall being pressed onto the section 8*a* under the action of gravity. In addition, the separating wall is pressed against the section 9 by clamping with a cover device (not illustrated). The collecting and/or distributing device which is pre-stabilized in this way can subsequently be soldered.

Figure 15D:
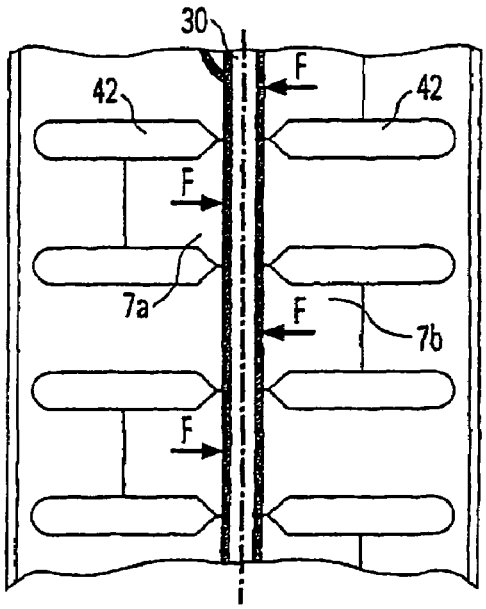
FIG. 15*d* is a schematic illustration of a base device according to the invention.

FIG. 15*d* schematically shows a plan view of the base device according to the invention. Here, the reference symbols 42 relate to end sections of the throughflow devices 40 which are inserted through the base device. The reference symbols 7*a* and 7*b* also relate here to projections which are in this case arranged alternately and each exert a force, denoted by F, on the separating wall 30. In this case, the separating wall is stabilized relative to the base device by means of the alternating projections 7*a*, 7*b*. At the same time, however, a flux can flow off from the step, which is arranged in each case at one side, toward the side which is in each case situated opposite a step which is present.

Figure 16:
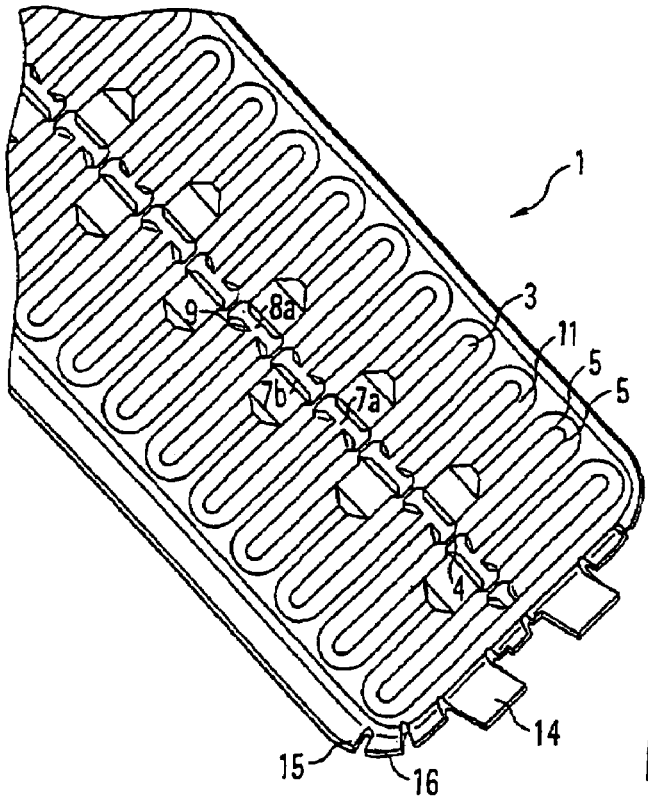
FIG. 16 shows a rearward view of a further embodiment of the base device according to the invention.

FIG. 16 shows a rear view of a further embodiment of a base device according to the invention, that is to say, in this illustration, the throughflow devices are inserted in the direction into the plane of the page. In this case, alternating steps 7*a* and 7*b* are provided, as are auxiliary projections 12*a* and 12*b* which facilitate insertion of the separating wall. The narrowed region 4, which is matched to the region 45 of the throughflow device, can also be clearly seen in said embodiment. The reference symbols 15 relate to an edge region of the base device, and the reference symbol 16 relates to a lug which serves for connecting the cover device (not illustrated). The lugs 14 likewise serve to provide a connection to a cover device.

Figure 17:
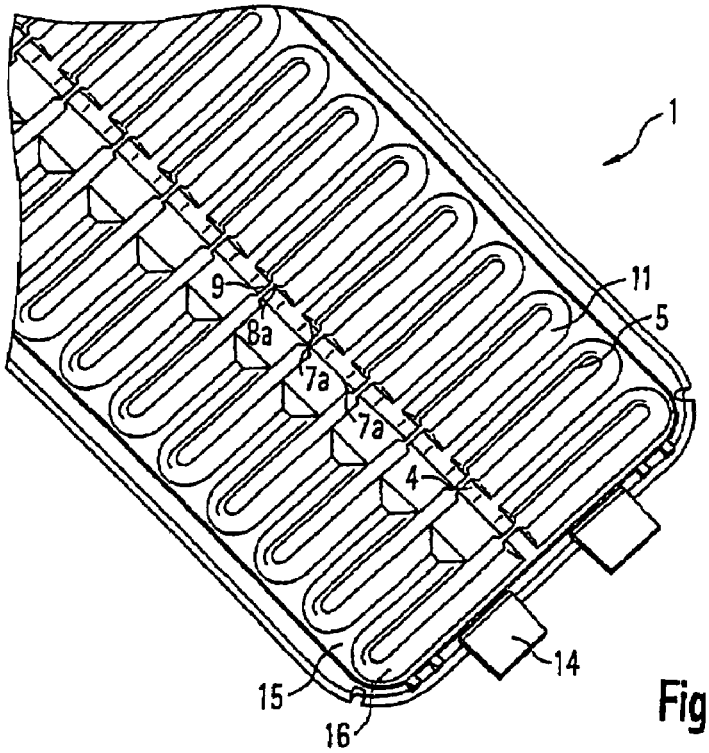
FIG. 17 is a further illustration of the base device according to the invention.

FIG. 17 shows a further embodiment of a base device according to the invention in this case having a step 7*a* at one side. As in the embodiment shown in FIG. 16, it is also possible here for the flux to flow off laterally into the regions 11 during production, so that an accumulation of the flux in the region of the plate section 9 can be prevented in this way. The openings 3 are, as described above, through openings which have a considerably narrowed cross section in the intermediate region 4. It would also be possible to fully close the intermediate region 4, but in this case it would be necessary for the throughflow devices to have a corresponding cut-out in said region. Two lugs 14 and an edge region 15 and a further lug 16, which serve to provide a connection to a cover device (not shown), are also provided in said embodiment.

Figure 18:
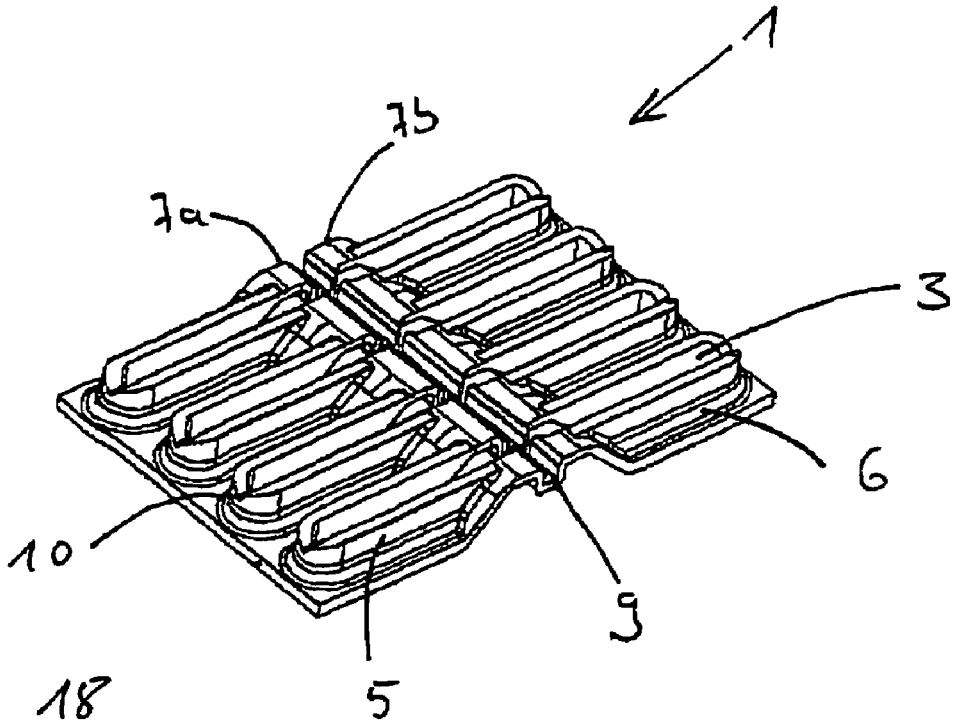
FIG. 18 is a perspective illustration of a further embodiment of the base device according to the invention.

FIG. 18 shows a perspective view from above of a further embodiment of the base device 1 of the heat exchanging apparatus according to the invention. The base device 1 has passage openings 3 which are enclosed by collars 5. Here, the collars 5 are connected by means of chamfers 6 to a foundation 13 of the base device 1. Approximately centrally, and transversely with respect to the passage openings for holding corresponding flat tubes (not illustrated), the plate section 9 is illustrated with the projections 7*a*, 7*b* for holding the separating wall. One gap 11 is arranged at the outer ends of the collars of the passage openings in each case. The passage openings 3 and collars 5 with the gap 11 can be generated by means of a combined cracking and punching process.

Figure 19:
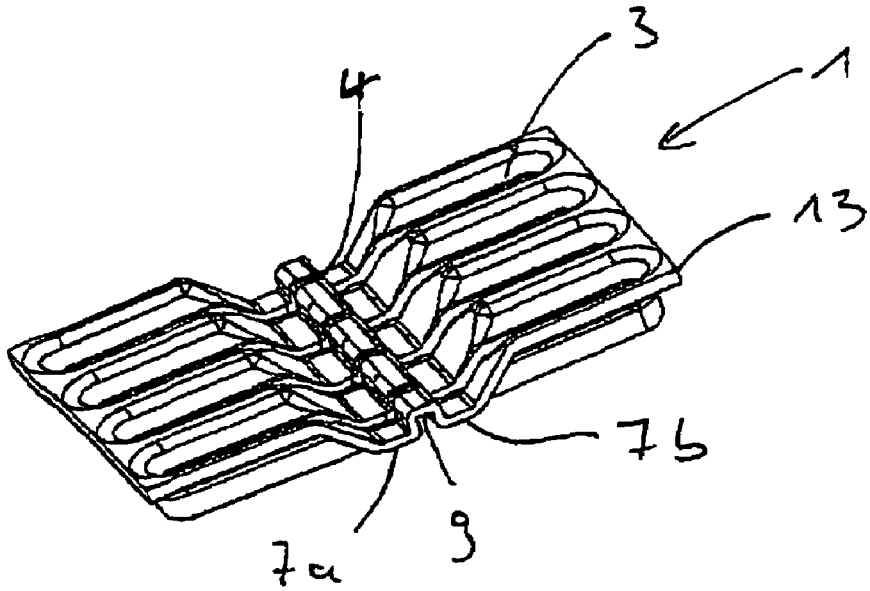
FIG. 19 shows a rearward view of the further embodiment of the base device according to the invention.

FIG. 19 shows the base device 1 of FIG. 18 from below, that is to say in a rear view. The narrowed regions 4 of the passage openings 3 can be seen in addition to the passage openings 3 and the plate section 9 with the projections 7*a*, 7*b*.

Figure 20:
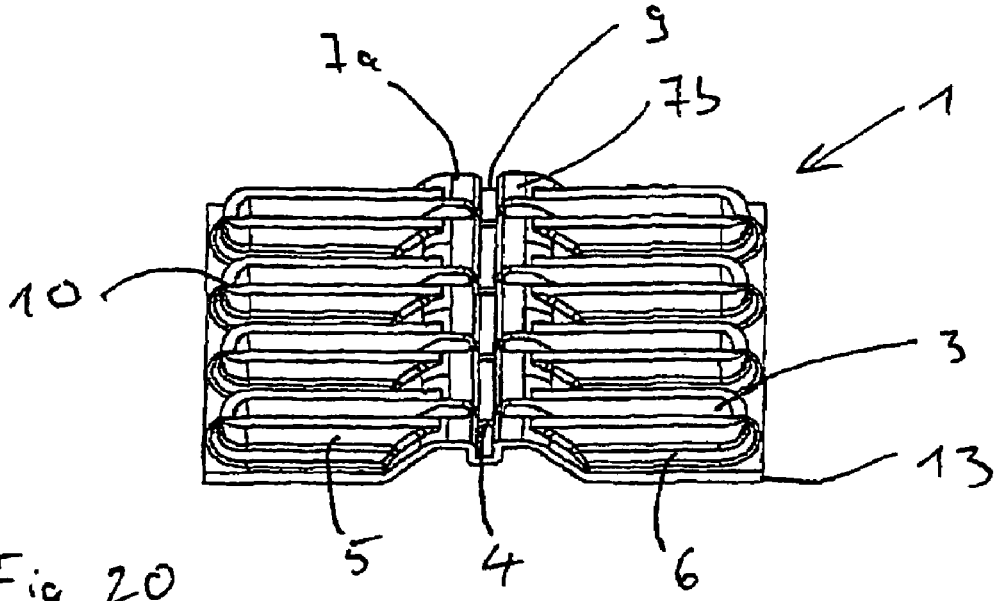
FIG. 20 is a further illustration of the base device according to the invention according to FIG. 18.
Figure 21:
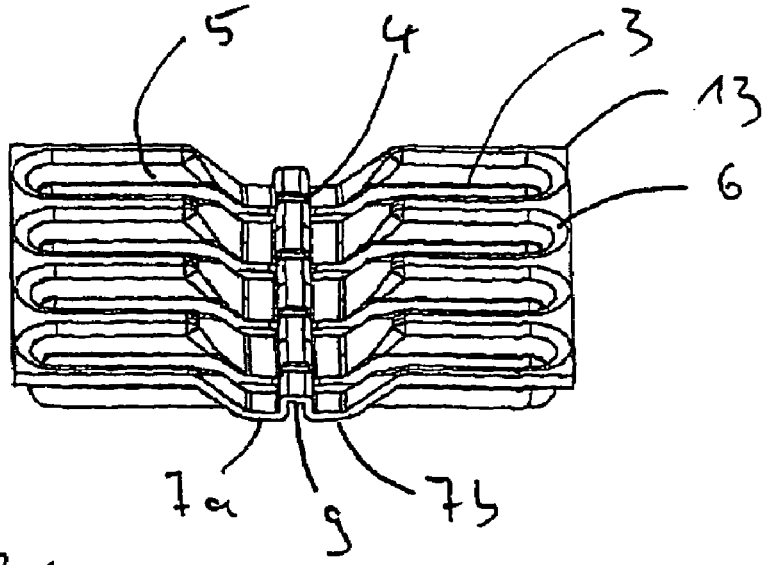
FIG. 21 shows a rearward view of a further embodiment of the base device according to the invention according to FIG. 18.

FIG. 20 and FIG. 21 correspond to FIGS. 18 and 19 in a further perspective view. For explanation, reference is therefore made to the above description of FIGS. 18 and 19.

Figure 22:
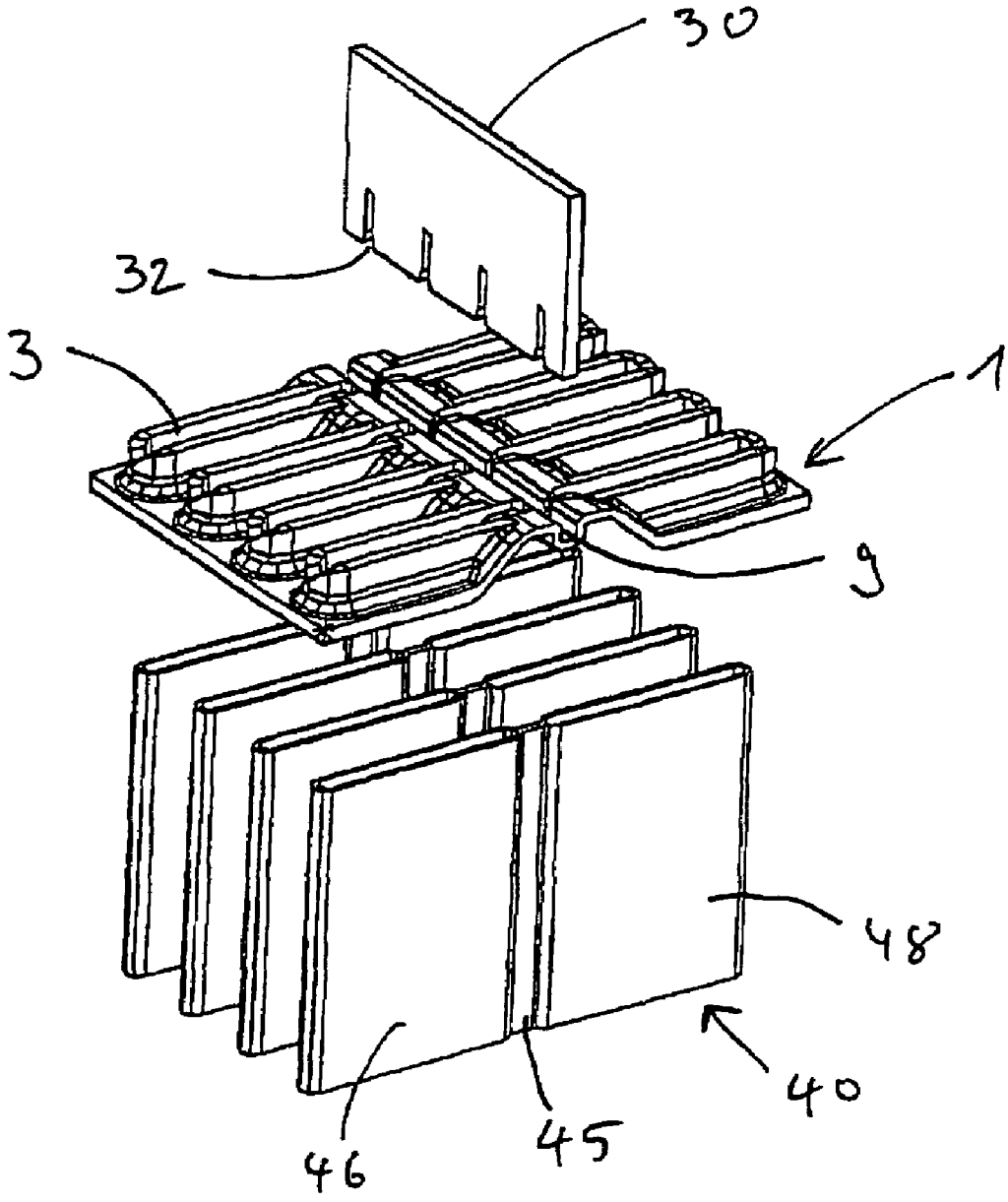
FIG. 22 is an exploded illustration of the heat exchanging apparatus according to the invention.

FIG. 22 shows the heat exchanging apparatus according to the invention using the base device of FIG. 18. Flat tubes or throughflow devices 40 having flow chambers 46 and 48 and the narrowed region are inserted into the base device 1 through the passage openings 3 with their narrowed region 4. A separating wall 30 having slots 32 is inserted into the plate section 9, said separating wall serving to provide separation of the flow.

Figure 23:
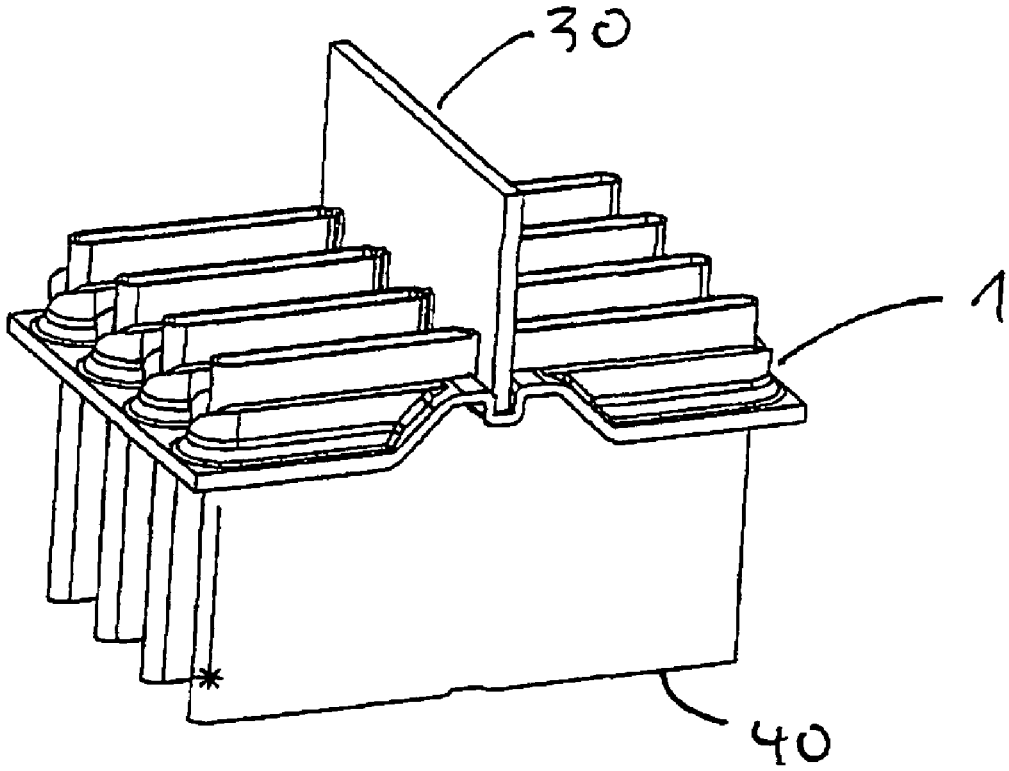
FIG. 23 is an illustration of the apparatus according to FIG. 22.

FIG. 23 shows the apparatus according to FIG. 22 comprising a base device 1, a plurality of throughflow devices 40 which have been inserted, and a separating wall 30.

Figure 24:
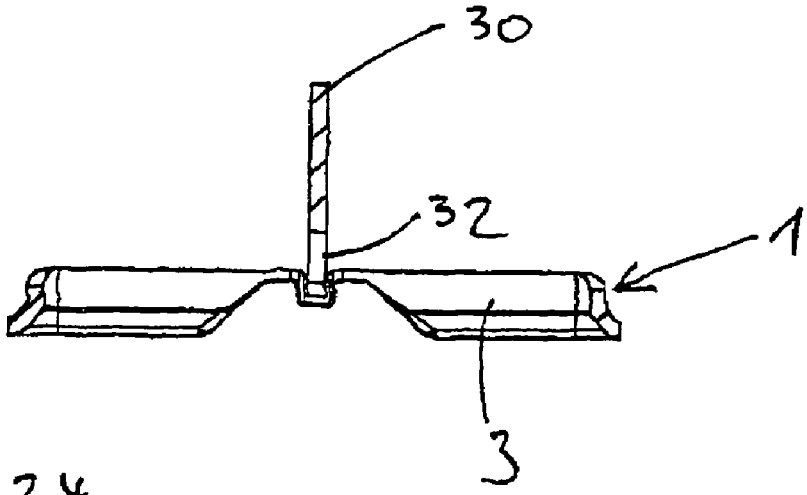
FIG. 24 shows a cross section of the base device from FIG. 23, transversely with respect to the separating wall, along a separating wall slot.

FIG. 24 shows a section, perpendicular to the separating wall 30 which has been inserted, through the base device 1 of FIG. 18, the section running through a slot 32 of the separating wall 30 and therefore along the passage opening 3.

Figure 25:
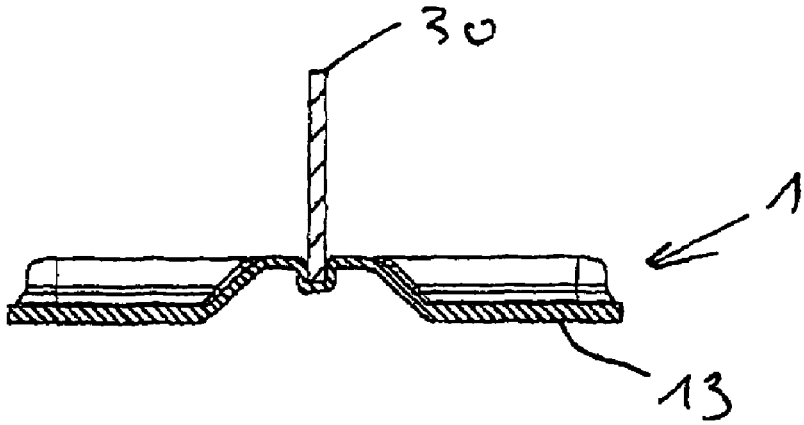
FIG. 25 shows a cross section of the base device from FIG. 23, transversely with respect to the unslotted separating wall.

FIG. 25 shows a further section, perpendicular to the separating wall 30 which has been inserted, through the base device 1 of FIG. 18, the section running through a region of the separating wall 30 without a slot and therefore not along a passage opening, so that the foundation 13 of the base device 1 can be seen.

Figure 26:
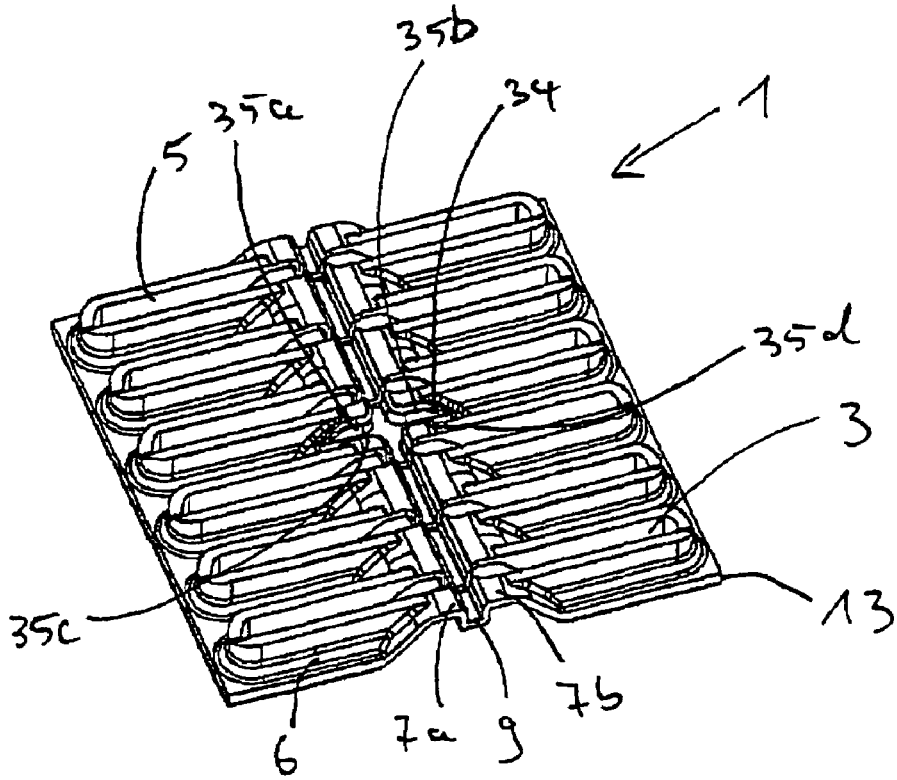
FIG. 26 is a perspective illustration of a further embodiment of the base device according to the invention.

FIG. 26 shows a further embodiment of a base device 1 having passage openings 5 which are enclosed by collars 5 which are arranged on chamfers 6, the chamfers 6 providing the connection to the foundation 13 of the base device. Similarly to the base device of FIG. 18, a plate section 9 is provided which runs substantially perpendicular to the passage openings 3 and has opposing projections 7*a*, 7*b*, said plate section 9 serving to hold a separating wall (not illustrated). In contrast to the embodiment of FIG. 18, a further holding section 34 is provided which runs perpendicular to the plate section 9 and has guide faces 35*a*, 35*b*, 35*c* and 35*d* which stand perpendicular on the plane of the base device. A further separating wall can be inserted into the base device 1 by means of the holding section 34 and the guide faces 35*a*, 35*b*, 35*c* and 35*d*, making it possible for the flow to be divided into four.

Figure 27:
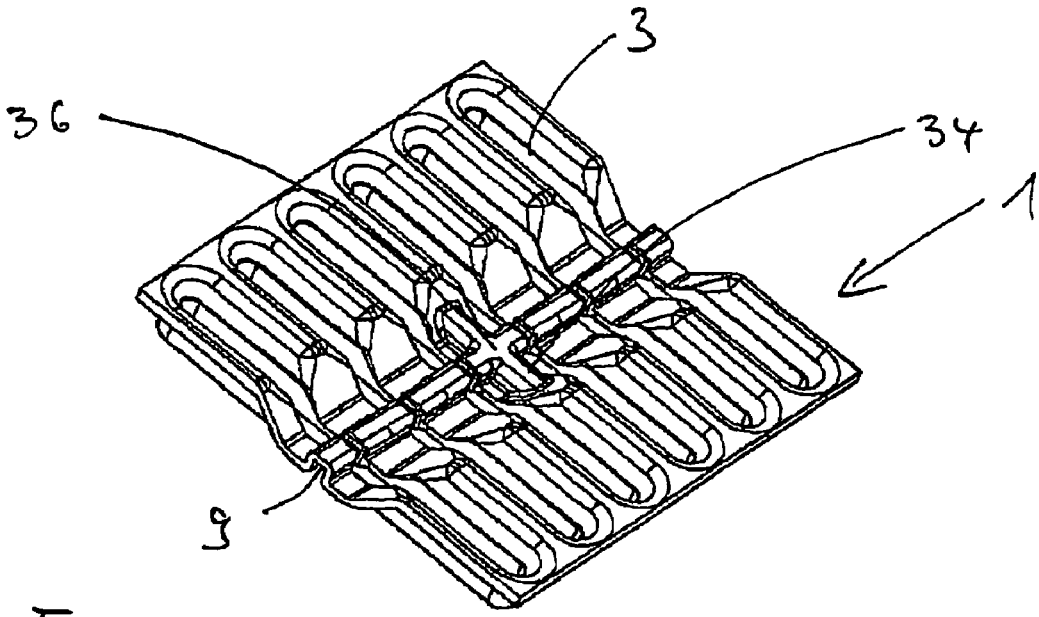
FIG. 27 shows a rearward view of the further embodiment of the base device according to the invention.

FIG. 27 shows a rear view of the base device 1 of FIG. 26. It can be seen that the intersection of the two holding sections 9 and 34 is in the shape of a cross 36 in the rear view.

Figure 28:
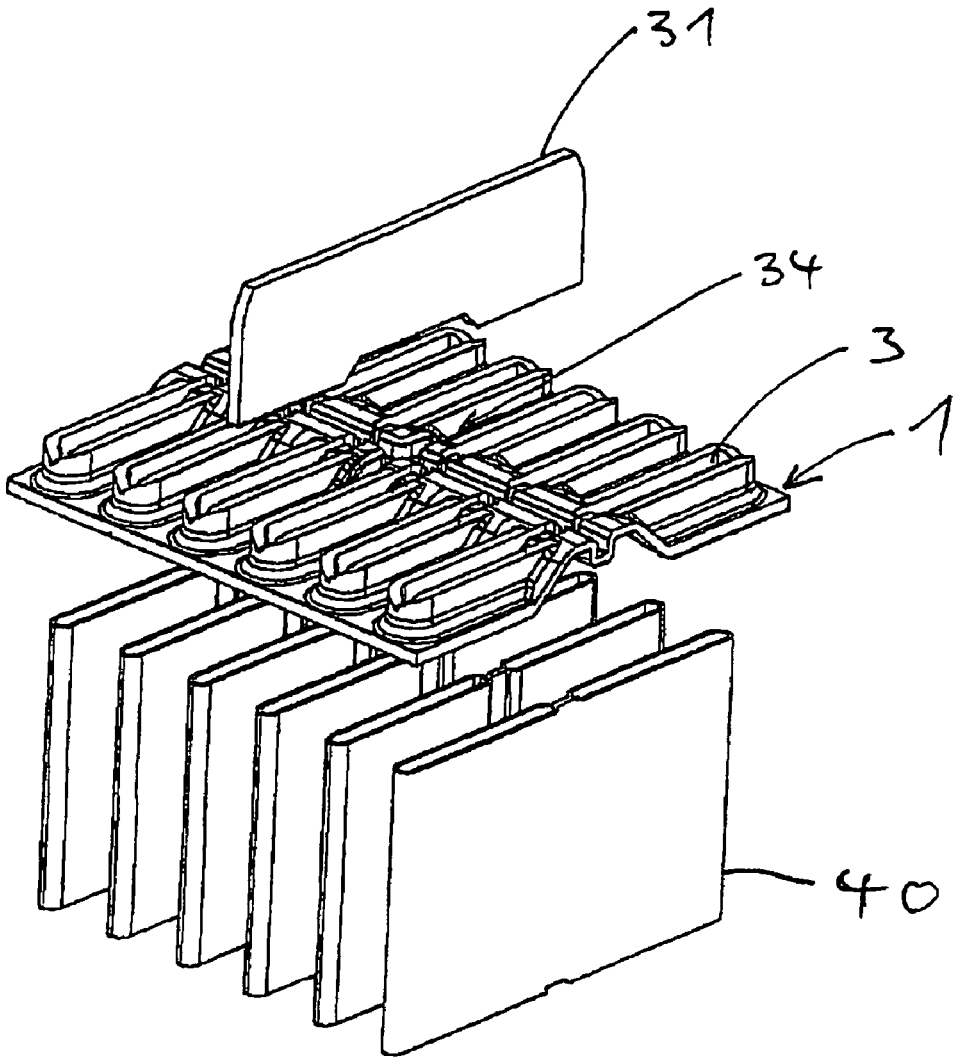
FIG. 28 is an exploded illustration of the further embodiment of the heat exchanging apparatus according to the invention.

FIG. 28 is an exploded illustration of an embodiment of the heat exchanging apparatus according to the invention having a base device 1 as per FIG. 26, a further separating wall 31 and a plurality of throughflow devices 40. The further separating wall 31 runs in the direction of the elongate passage openings 3 and leads to flow being divided into two regions if only said further separating wall 31 is used. If a corresponding "first" separating wall 30 (not illustrated) is inserted in the plate section 9, the flow is divided into four.

Figure 29:
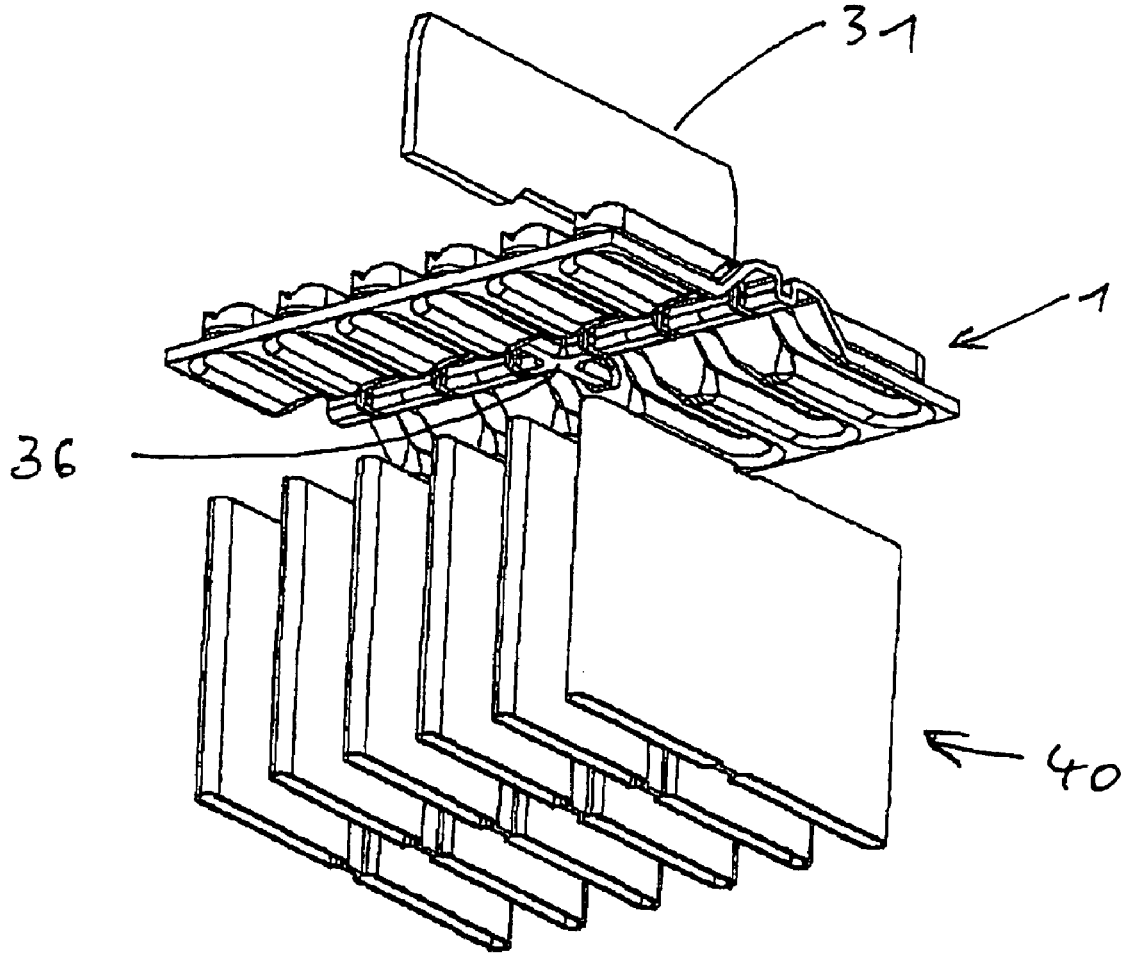
FIG. 29 is an exploded illustration of the further embodiment of the heat exchanging apparatus according to the invention in a rearward view.

FIG. 29 is an exploded illustration of the embodiment of the heat exchanging apparatus according to the invention of FIG. 28 in a rear view, having a base device 1 as per FIG. 26, a further separating wall 31 and a plurality of throughflow devices 40. The cross 36, which is arranged approximately centrally in the base device 1, can be seen, so that a separating wall can be inserted which runs either in the direction perpendicular to or the direction parallel to the passage openings 3.

Figure 30:
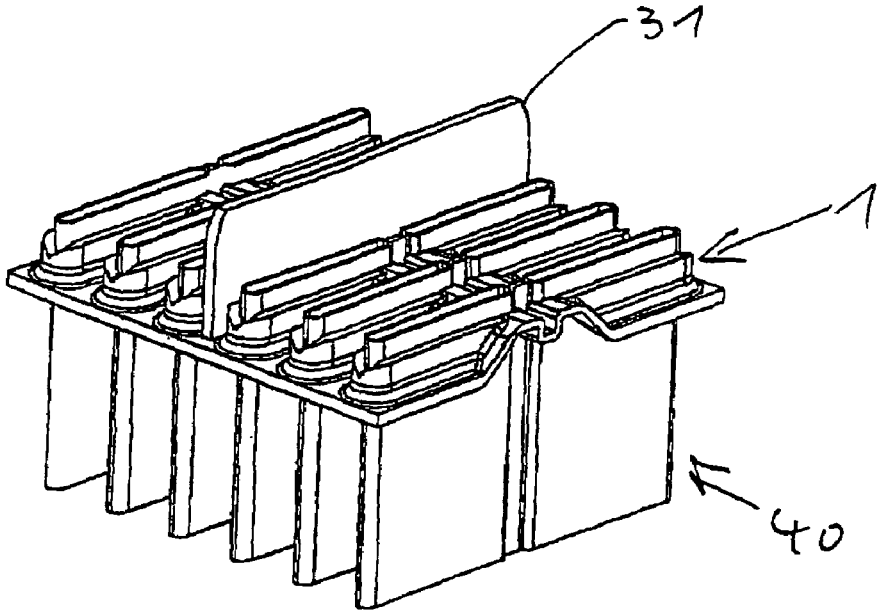
FIG. 30 is a perspective illustration of the further embodiment of the heat exchanging apparatus according to the invention.

FIG. 30 shows the heat exchanging apparatus according to FIG. 28 in the assembled state having the separating wall 31, base device 1 and a plurality of flat tubes 40.

Figure 31:
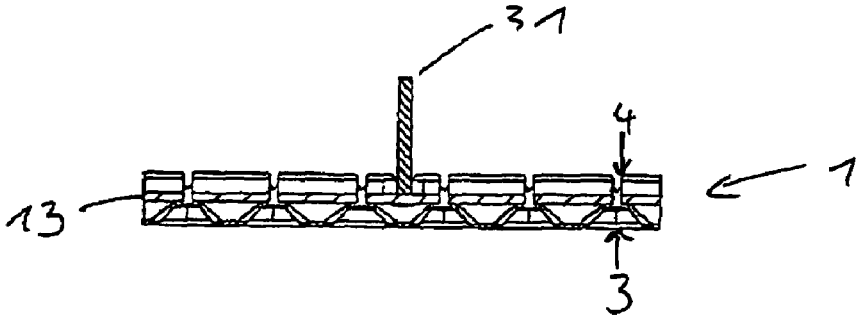
FIG. 31 shows a cross section through the base device of the apparatus according to FIG. 30.

Finally, FIG. 31 shows a cross section through a base device 1, which has been provided with a further separating wall 31, along the plate section 9 of FIG. 26, so that the narrowed regions 4 of the passage openings 3 in the foundation 13 can be seen.

The invention claimed is:

1. A heat exchanging apparatus for a motor vehicle, comprising:

at least one first collecting and/or distributing device for at least one liquid medium; and a plurality of throughflow devices, the collecting and/or distributing device being fluidically connected to the plurality of throughflow devices through which the medium flows at least in sections, wherein the collecting and/or distributing device comprises at least one base device, one cover device and one separating device which divides the collecting and/or distributing device into at least two partial spaces, wherein the base device comprises a support level with openings through which the plurality of throughflow devices protrude, a predefined plane of the base device situated above the support level so as to protrude more inward with respect to the collecting and/or distributing device, and at least one projection which protrudes inward with respect to the collecting and/or distributing device from the predefined plane of the base device, wherein at least one section of the separating device is in at least indirect contact with at least one side face of the projection and with at least one section of the plane of the base device, and wherein the at least one projection is formed by a vertical wall projecting upward from the predefined plane, an inclined wall projecting upward at an angle from the support level, and a horizontal wall connecting the vertical and inclined walls.

2. The apparatus as claimed in claim 1, wherein the at least one side face of the inwardly protruding projection forms a substantially right angle with the plane of the base device, and wherein the separating device is arranged at said right angle.

3. The apparatus as claimed in claim 1, wherein the base device further comprises a plurality of inwardly protruding projections.

4. The apparatus as claimed in claim 3, wherein the plurality of inwardly protruding projections are arranged substantially in a straight line.

5. The apparatus as claimed in claim 4, wherein side faces of the projections which are in contact with the separating device are arranged substantially in a plane.

6. The apparatus as claimed in claim 3, wherein a plane in which side faces of the projections are arranged are aligned substantially perpendicular to the plane of the base device.

7. The apparatus as claimed in claim 3, wherein the inwardly protruding projections extend substantially continuously in a longitudinal direction of the base device.

8. The apparatus as claimed in claim 3, wherein the separating device is in at least indirect contact with at least one side face of all the inwardly protruding projections.

9. The apparatus as claimed in claim 1, wherein the separating device has a thickness of from 0.2 mm-5 mm.

10. The apparatus as claimed in claim 1, wherein the inwardly protruding projection has a surface which runs substantially parallel to the plane of the base device.

11. The apparatus as claimed in claim 1, wherein the inwardly protruding projection has a face which runs substantially obliquely with respect to the plane of the base device at a predefined angle.

12. The apparatus as claimed in claim 1, wherein the inwardly protruding projection has a height of between 0.2 mm and 5 mm.

13. The apparatus as claimed in claim 1, wherein a connecting medium is provided in a contact region between the base device and the separating device.

14. The apparatus as claimed in claim 13, wherein the connecting medium is selected from a group of connecting media which includes solders and flux.

15. The apparatus as claimed in claim 1, wherein the separating device is embodied as a separating wall.

16. The apparatus as claimed in claim 1, wherein the openings have a substantially slotted-hole-like profile.

17. The apparatus as claimed in claim 1, wherein the openings have flanges through which the throughflow devices are inserted.

18. The apparatus as claimed in claim 17, wherein the flanges point inward with respect to the collecting and/or distributing device.

19. The apparatus as claimed in claim 17, wherein ends of the flanges are arranged at a level which differs from the plane of the base device.

20. The apparatus as claimed in claim 19, wherein the plane of the base device is arranged higher than the ends of the flanges.

21. The apparatus as claimed in claim 1, wherein a plane defined by the separating device substantially represents a plane of symmetry of the base device.

22. The apparatus as claimed in claim 1, wherein the length of the base device exceeds the length of the separating device.

23. The apparatus as claimed in claim 1, wherein each of the plurality of throughflow devices has a substantially flat-tube-like cross section, which is inserted into one of the openings.

24. The apparatus as claimed in claim 1, wherein the at least one side face of the inwardly protruding projection which is in at least indirect contact with the separating device is larger than the at least one section of the base device which is in at least indirect contact with the separating device.

25. The apparatus as claimed in claim 1, wherein the at least one section of the base device which is in at least indirect contact with the separating device is wider than the thickness of the separating device.

26. The apparatus as claimed in claim 1, wherein the support level with openings is formed by a plurality of support devices.

27. The apparatus as claimed in claim 26, wherein the support devices are arranged substantially between the openings.

28. The apparatus as claimed in claim 26, wherein the base device further comprises a plurality of inwardly protruding projections, and wherein at least some of the support devices merge into the plurality of projections.

29. The apparatus as claimed in claim 1, wherein the base device has a projecting peripheral edge.

30. The apparatus as claimed in claim 1, wherein the base device has at least one lug at its periphery.

31. The apparatus as claimed in claim 1, wherein the separating device runs parallel to the openings.

32. The apparatus as claimed in claim 31, wherein the separating device is arranged in a holding section which has guide faces.

33. The apparatus as claimed in claim 1, wherein the inclined wall of the projection projecting upward at an angle from the support level is a flat wall with a curved connection at the horizontal wall.

34. The apparatus as claimed in claim 1, further comprising collars for securing the plurality of throughflow devices through the apertures in the base device, wherein the collars protrude upward from the support level.

35. A heat exchanging apparatus for a motor vehicle, comprising:

at least one first collecting and/or distributing device for at least one liquid medium; and a plurality of throughflow devices, the collecting and/or distributing device being fluidically connected to the plurality of throughflow devices through which the medium flows at least in sections, wherein the collecting and/or distributing device comprises at least one base device, one cover device and one separating device which divides the collecting and/or distributing device into at least two partial spaces, wherein the base device has a plurality of inwardly protruding projections which protrudes inward with respect to the collecting and/or distributing device from a predefined plane of the base device, wherein at least one section of the separating device is in at least indirect contact with at least one side face of a portion of the plurality of projections and with at least one section of the plane of the base device, and wherein the plurality of projections are arranged so as to be alternately laterally offset relative to one another with respect to a transverse direction of the collecting and/or distributing device.

36. The apparatus as claimed in claim 35, wherein the side faces of the portion of the plurality of projections which are alternately laterally offset relative to one another and are in contact with the separating device are situated obliquely opposite one another at a predefined angle.

37. The apparatus as claimed in claim 35, wherein the separating device is arranged between the portion of the plurality of projections which are arranged offset relative to one another in each case.

38. A method for producing a heat exchanging apparatus comprising the following method steps:

producing a base device, wherein the base device comprises a support level with openings, a predefined plane of the base device situated above the support level, and at least one projection which protrudes upward from the predefined plane of the base device;

applying at least one connecting medium to at least one side face of the projection, and to at least one section, which adjoins the at least one side face of the projection, of the base device; and arranging a separating device on the base device, the separating device being in at least indirect contact with the base device and the at least one side face of the projection, wherein the at least one projection is formed by a vertical wall projecting upward from the predefined plane, an inclined wall projecting upward at an angle from the support level, and a horizontal wall connecting the vertical and inclined walls.

39. The method as claimed in claim 38, wherein the at least one inwardly protruding projection is generated by a machining operation on the base device, the machining operation being selected from a group of machining operations which includes punching and deep-drawing.

40. The method as claimed in claim 38, wherein a plurality of inwardly protruding projections is generated.

41. The method as claimed in claim 38, wherein the at least one section of the base device which adjoins the inwardly protruding projection runs substantially in the predefined plane of the base device.

42. The method as claimed in claim 38, wherein the support level is formed by at least one support device generated in the base device.

43. The method as claimed in claim 38, wherein the support level is formed by at least one support device generated in the base device such that the at least one support device merges into the at least one inwardly protruding projection.

44. The method as claimed in claim 38, wherein the openings are punched into the base device.

45. The method as claimed in claim 38, wherein one flat-tube-like throughflow device is at least partially inserted into each opening, and a positively locking connection, a cohesive connection, a non-positively locking connection, or a combination thereof is generated between the base device and each throughflow device.

46. The method as claimed in claim 38, wherein a non-positively locking connection, a positively locking connection, a cohesive connection, or a combination thereof between the base device and a plurality of throughflow devices is generated by a method selected from a group which includes soldering, brazing, welding, or a combination thereof.

47. The method as claimed in claim 38, wherein the separating device is pressed with a predefined force both against the at least one side face of the projection and also against the at least one section of the base device.

48. The method as claimed in claim 38, wherein edges which surround the base device are generated by a further method step.

49. A heat exchanging apparatus for a motor vehicle, comprising:

at least one first collecting and/or distributing device for at least one liquid medium; and a plurality of throughflow devices, the collecting and/or distributing device being fluidically connected to the plurality of throughflow devices through which the medium flows at least in sections, wherein the collecting and/or distributing device comprises at least one base device, one cover device and one separating device which divides the collecting and/or distributing device into at least two partial spaces, wherein the base device has at least one projection which protrudes inward with respect to the collecting and/or distributing device from a predefined plane of the base device, wherein at least one section of the separating device is in at least indirect contact with at least one side face of the projection and with at least one section of the plane of the base device, wherein each throughflow device has a substantially flat-tube-like form with a first flow chamber, a second flow chamber, and a narrowed region between the first and second flow chambers in which the first and second flow chambers and the narrow region protrude into the base device, and wherein the at least one projection is formed by a vertical wall projecting upward from the predefined plane, an inclined wall projecting upward at an angle from a support level, and a horizontal wall connecting the vertical and inclined walls.

* * * * *